US007832960B2

(12) United States Patent
Home et al.

(10) Patent No.: US 7,832,960 B2
(45) Date of Patent: Nov. 16, 2010

(54) ALL-CONDITIONS TUNNEL BORING MACHINE

(75) Inventors: Lok Home, Chagrin Falls, OH (US); Brian Khalighi, Bellevue, WA (US); John Turner, Newcastle, WA (US)

(73) Assignee: The Robbins Company, Solon, OH (US)

( * ) Notice: Subject to any disclaimer, the term of this patent is extended or adjusted under 35 U.S.C. 154(b) by 211 days.

(21) Appl. No.: 12/337,113

(22) Filed: Dec. 17, 2008

(65) Prior Publication Data

US 2010/0148566 A1 Jun. 17, 2010

(51) Int. Cl.
*E21D 9/06* (2006.01)

(52) U.S. Cl. ..... 405/146; 405/141; 299/33

(58) Field of Classification Search ..... 405/138, 405/141, 142, 143, 144, 146, 147, 148; 299/31, 299/33

See application file for complete search history.

(56) References Cited

U.S. PATENT DOCUMENTS

| | | | | |
|---|---|---|---|---|
| 3,870,368 | A * | 3/1975 | Winberg et al. | 405/141 |
| 3,905,645 | A | 9/1975 | Bland | |
| 3,967,463 | A | 7/1976 | Grandori | |
| 4,192,556 | A | 3/1980 | Grandori | |
| 4,420,188 | A | 12/1983 | Robbins | |
| 4,527,837 | A | 7/1985 | Snyder | |
| 4,637,657 | A | 1/1987 | Snyder | |
| 4,804,295 | A * | 2/1989 | Kondo | 405/141 |
| 4,915,453 | A | 4/1990 | Fikse | |
| 5,005,911 | A | 4/1991 | Fikse | |
| 5,104,262 | A | 4/1992 | Forsberg et al. | |
| 5,174,683 | A * | 12/1992 | Grandori | 405/141 |
| 5,645,375 | A * | 7/1997 | Stephens | 405/146 |
| 5,890,771 | A | 4/1999 | Cass | |
| 6,554,368 | B2 * | 4/2003 | Drake et al. | 405/146 |

(Continued)

FOREIGN PATENT DOCUMENTS

JP 01239299 A * 9/1989

OTHER PUBLICATIONS

Remo Grandori, Manfred Jaeger, Fabrizio Antonini and Luis Vigl, "Envinos-Mornos Tunnel-Greece", 1995 RETC Proceedings, 1995, Chapter 47, pp. 747-767.

(Continued)

*Primary Examiner*—Frederick L Lagman
(74) *Attorney, Agent, or Firm*—Pearne & Gordon LLP

(57) ABSTRACT

A tunnel boring machine is provided comprising a cutter head, a main beam, a first, second, and third shield; and a ground conditioning work zone within the first shield, a gripper assembly, a segment erector arm for lining the tunnel, and at least one propulsion mechanism. The ground conditioning work zone includes at least one probing device for probing the terrain ahead of the cutter head. The first shield is configured to be retracted relative to the second shield to provide access for the ground conditioning work zone to apply at least one ground support device. The at least one propulsion mechanism moves the cutter head, the first and the second shield forward while the third shield and the gripper assembly remain stationary. The ground support devices can include filling a hole with a ground conditioning agent; and placing a bolt, ring beam, mesh, or shotcrete in/on the tunnel wall.

31 Claims, 24 Drawing Sheets

U.S. PATENT DOCUMENTS

| | | | | |
|---|---|---|---|---|
| 6,595,724 | B2 * | 7/2003 | Konda et al. | 405/141 |
| 7,040,712 | B2 * | 5/2006 | Sakae et al. | 405/141 |

OTHER PUBLICATIONS

Brian Fulcher, Michael Bell and Knut Garshol, "Pre-Excavation Drilling and Grouting for Water Control and Ground Improvement in Highly Variable Ground Conditions at the Arrowhead Tunnels Project", dated at least as early as Dec. 16, 2008, pp. 749-765.

2005 RETC Proceedings, Northeast Interceptor Sewer Case History, 2005, pp. 362-364.

R.D. Gutridge and D. Rendini, "Design and Construction of the Shoal Creek Raw Water Intake at Lake Lanier", 2005 RETC Proceedings, 2005, Chapter 88, pp. 1115-1125.

E. Fernandez, "Double Shields to Build the High Speed Railway Network in Spain", 2005 RETC Proceedings, 2005, Chapter 36, pp. 470-484.

R. Grandori and L. Pellegrini, "Tunneling Through Faults in Volcanic Rocks for the Construction of the La Joya Project (Costa Rica)", 2007 RETC Proceedings, 2007, pp. 266-279.

F. Mendana, "Guadarrama Tunnel Construction with Double Shield TBMS", 2007 RETC Proceedings, 2007, pp. 1079-1093.

* cited by examiner

ALL-CONDITIONS TUNNEL BORING MACHINE

BACKGROUND OF THE INVENTION

The present invention relates generally to a tunnel boring machine (TBM) and other machines that are configured to drill tunnels through various ground conditions and a wide range of geology. In some environments, it is cost prohibitive to completely test the geology of the path that the tunnel will traverse.

A main beam TBM is considered an "open" machine. The main beam TBM can have a shield in a forward location but does not include shields in the rearward locations of the TBM. The main beam TBM includes a cutter head and hydraulic propel cylinders that push the cutters into the rock. The transfer of this high thrust through the rolling disc cutters create fractures in the rock causing chips to break away from the tunnel face. Gripper shoes can be provided to push on the sidewalls to react the machine's forward thrust. The gripper shoes can move along the main beam. At the end of a stroke, the rear legs of the machine are lowered, the grippers and propel cylinders are retracted. The retraction of the propel cylinders repositions the gripper assembly for the next boring cycle. The grippers are extended, the rear legs lifted, and boring begins again.

Main beam and open machine designs are usually used in hard rock and can be used in unlined tunnels. The main beam TBM may have to removed from the tunnel to install tunnel lining segments. Open machines can get inundated with debris if the condition of the terrain that is being bored becomes unstable due to a lack of shields located behind the cutter head. Shielded machines have been provided for giving additional protection for operators. However, shielded machines have a risk of getting trapped and a long single shield can get trapped just as well as the double shield design can get trapped.

One example of a shielded machine is a single shield design that can be used when sections of broken ground must be bored through. The single shield design does not include a main beam. A single shield design can include one articulation with only one way to propel the TBM, through the use of thrust cylinders against tunnel lining segments. The thrust cylinders are used to push off the latest pre-cast concrete tunnel lining segment, as installed by a segment erector. In the single shield design, tunnel boring and tunnel lining erection are sequential operations, as one boring stroke can be made, and then a subsequent lining segment must be installed.

One example of a shielded machine is a double shield TBM. A double shield TBM includes a cutter head with a first shield, a second shield, a gripper shield, and a tail shield. A double shield is typically used in environments where there is fractured rock. The Double Shield TBM and the Single Shield TBM do not include a main beam. Instead, these TBMs have only various cylinders located about the central axis of the machine to carry reactions provided by the various shields. For the double shield design, the first shield telescopes within the larger second shield when the TBM moves forward. In normal operation of the double shield mode, the gripper shoes are energized, pushing against the tunnel walls to react against the boring forces. Propel cylinders are provided about the periphery of the double shield TBM in front of the gripper shoes and near the cutter head in the front of the double shield TBM. The propel cylinders are then extended to push the cutter head support and push the cutter head forward. The rotating cutter head cuts the rock. The telescopic shield extends as the machine advances keeping everything in the machine under cover and protected from the ground surrounding it. A segment erector is fixed to the gripper shield allowing pre-cast concrete tunnel lining segments to be erected while the machine is boring at a location to the rear of the gripper shoe. If the ground becomes too weak to support the gripper shoe pressure, the machine thrust must be reacted another way. In this situation, a double shield machine can be operated in "single shield mode." Auxiliary thrust cylinders are located in the gripper shield. The thrust cylinders are used to push off the latest pre-cast concrete tunnel lining segment. In the single shield mode, tunnel boring and tunnel lining erection are sequential operations, as one boring stroke can be made, and then a subsequent lining segment must be installed. Regardless of the operating mode, working crews remain protected within the shields.

The Double Shield TBM can include a probe drill. Due to the location of the propel cylinders about the periphery of the TBM, the probe drill is located to the rear of the gripper shoe. The probe drill can be used for probe drilling at an angle relative to the longitudinal axis of the TBM by entering the rock near the location of the gripper shoe which is set back rearwardly from the cutter head. The propel cylinders prevent the probe drill from being located closer to the front of the TBM.

Despite the current open and shielded designs, there is still a need to reduce the occurrence of a machine getting trapped in the terrain due to unexpected ground conditions causing a collapse of the tunnel. It is acknowledged that time can be of the essence when forming a tunnel. This being the case, then it would be desirable for the final tunnel lining to be set by the TBM. However, this may not be practical in highly stressed ground. The geological data suggest that squeezing ground condition can occur over extended sections of the tunnel alignment. Since this squeezing effect can have major effects on the final tunnel lining, the rock stress forces must come into a balance before the final tunnel lining can be placed. There is also a need to more efficiently pre-treat the rock in advance of the cutter head. Despite prior art attempts at TBMs, there still is a need for a TBM that is equipped to handle multiple types of ground conditions while still providing maximum speed for the TBM.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a tunnel boring machine is provided comprising a cutter head, a first shield, a ground conditioning work zone located within the first shield, a second shield located behind the first shield, a third shield located behind the second shield, a main beam, a gripper assembly located within the third shield, a segment erector arm movable along the main beam and located behind the third shield, and at least one first propulsion mechanism. The cutter head includes at least one cutting mechanism that is configured to bore out a tunnel having a tunnel wall. The first shield is located behind the cutter head about a perimeter of the cutter head and extends in a longitudinal direction away from the cutter head. The first shield, the second shield, and the third shield provide protection for an interior of the tunnel boring machine. The gripper assembly is configured to move a gripper shoe between an undeployed position and an extended position that is in contact with and applies force on the tunnel wall. The ground conditioning work zone includes at least one arm assembly for probing the terrain in advance of the cutter head. The at least one arm assembly is supported by the main beam within the ground conditioning work zone. The first shield is configured to be retracted relative to the second shield to provide access to the interior of the tunnel for the at least one arm assembly to apply at least one ground support device. The segment erector arm is configured to install a plurality of segments to line the tunnel wall. The at least one first propulsion mechanism includes one end in contact with the main beam and another end in contact with one of the third shield and the gripper assembly. The at least one first propulsion mechanism is configured to push against the third shield as it is secured in position by the gripper shoe when the gripper shoe is in a deployed position. The at least one first propulsion mechanism moves the cutter head, the first shield, and the second shield forward while the third shield and the gripper assembly remain stationary.

In accordance with another aspect of the present invention, a tunnel boring machine is provided comprising a cutter head, a conveyor configured to transport material cut by the cutter head, a main beam, a first shield, a ground conditioning work zone located within the first shield, a second shield located behind the first shield, a third shield located behind the second shield, a gripper assembly located within the third shield, an arm assembly supported by the main beam within the first shield, a segment erector arm movable along the main beam and located behind the third shield, at least one first propulsion mechanism, and at least one second propulsion mechanism. The cutter head includes at least one cutting mechanism that is configured to bore out a tunnel having a tunnel wall. The main beam is configured to support the conveyor. The first shield is located behind the cutter head about a perimeter of the cutter head and extends in a longitudinal direction away from the cutter head. The first shield, the second shield, and the third shield provide protection for an interior of the tunnel boring machine. The gripper assembly is configured to move a gripper shoe between an undeployed position and an extended position that is in contact with the tunnel wall wherein the gripper shoe applies force on the tunnel wall to secure the position of the third shield. The arm assembly includes at least one probing drill for drilling at least one hole to probe the terrain that has not yet been bored in front of the cutter head and in front of the first shield. The first shield is configured to be retracted relative to the second shield to provide access for the arm assembly to the interior of the tunnel wall. The arm assembly is further configured to apply at least one ground device when the first shield is retracted relative to the second shield at a location behind the cutter head and in advance of the second shield. The at least one ground support device includes at least one of the following: at least one ground conditioning agent that is configured to fill at least one of the holes upon a detection of unstable ground, water, or weak rocks; a bolt that is configured to secure the ground; a ring beam that is configured to secure the ground; a mesh structure that is configured to secure the ground; and an amount of shotcrete that is configured to be dispersed on the tunnel wall to secure the ground. The segment erector arm is configured to install a plurality of segments to line the tunnel wall as the cutter head is moving forward. The at least one first propulsion mechanism includes one end in contact with the main beam and another end in contact with one of the third shield and the gripper assembly. The at least one first propulsion mechanism is configured to push against the third shield as it is secured in position by the gripper shoe when the gripper shoe is in a deployed position. The at least one first propulsion mechanism moves the cutter head, the first shield, and the second shield forward while the third shield and the gripper assembly remain stationary. The at least one second propulsion mechanism includes a first end in contact with the third shield and a second end being movable. The at least one second propulsion mechanism is configured to push off with the second end pushing against the most recently installed segment of the tunnel wall to advance the cutter head, the first shield, the second shield, the third shield, and the gripper assembly.

BRIEF DESCRIPTION OF THE SEVERAL VIEWS OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
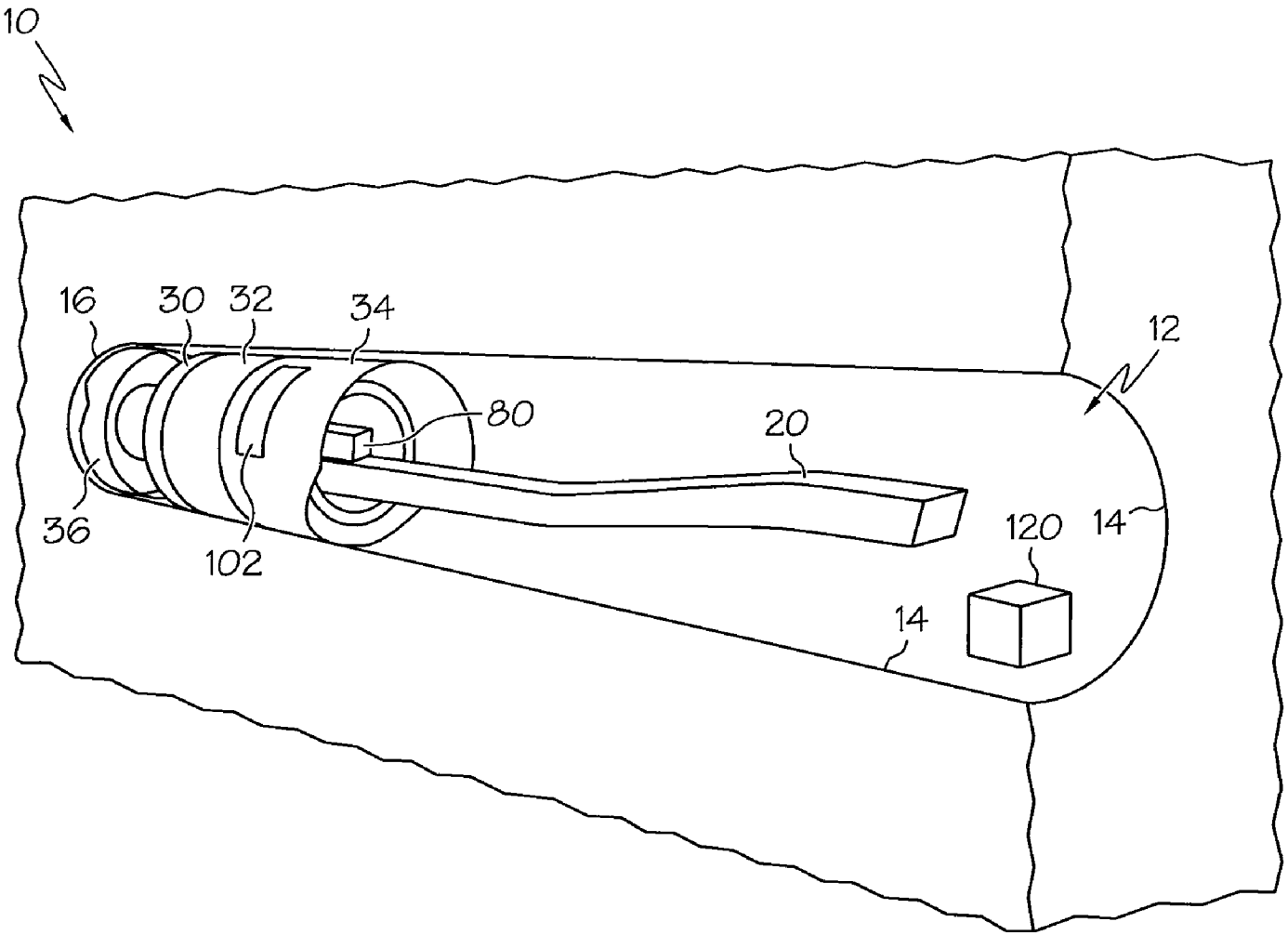
FIG. 1 is a rear perspective view of an example tunnel boring machine.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

As shown in FIG. 1, an example All-Conditions Tunneler (ACT) tunnel boring machine (TBM) 10 is provided. The TBM 10 is configured to bore out a tunnel 12 from the earth through different geological conditions, such as rock or through a mountain. Difficult geological conditions can include one or several of the following conditions:

- Squeezing ground; convergence within minutes/hours of opening;
- Loose ground at the face falling against cutter head 16 before advance occurs;
- Inrush of water and silts at faults or disturbed areas;
- Non-self-supporting rock;
- High temperatures; and
- Extremely hard abrasive rock The TBM 10 has to cope with all types of conditions and maintain predictable advance in each condition plus have predictable high performance in non-difficult ground. The TBM 10 can work in routine geological conditions, difficult ground conditions, mixed ground conditions, or unpredictable ground conditions. The TBM 10 is configured to bore out a tunnel 12 that has tunnel walls 14 from a variety of rock conditions, as will be described. The tunnel can have a substantially circular tunnel wall. As an example, the TBM 10 can be used in a variety of rock types including: agglomerate, tuff, granite, quartzite, basalt, diorite gneiss, hornblende gneiss, quartz schist, pure quartz, dolerite, hard sandstone, hard dolomite and limestone, siltstone, mudstone, shale, slate, and many others.

Figure 2:
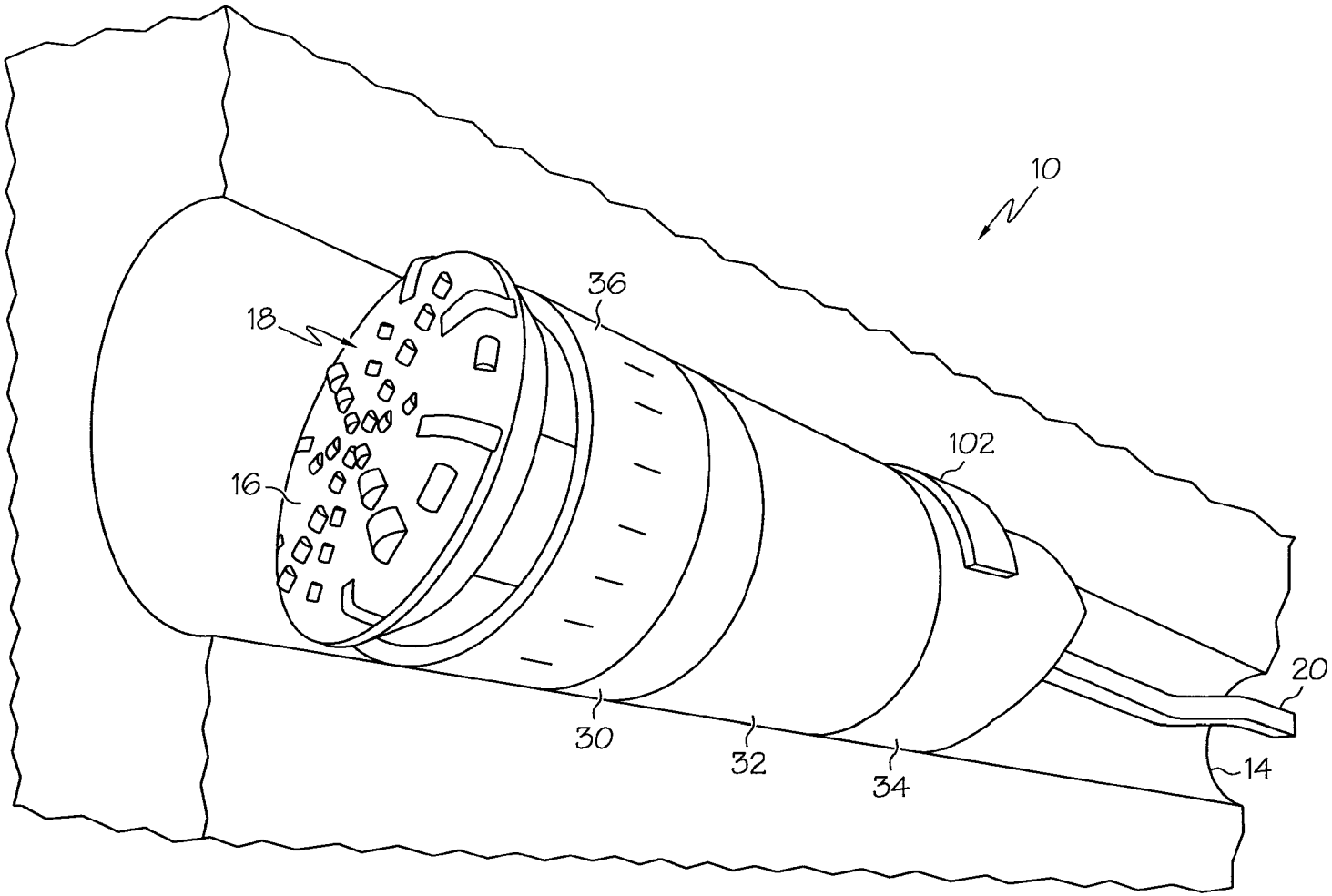
FIG. 2 is a front perspective view of the example tunnel boring machine of FIG. 1 showing a cutter head and a cutter head support assembly.

As shown in FIG. 2, the example TBM 10 is shown from a perspective front view. A cutter head 16 can be seen in this view which can include a variety of cutting mechanisms 18, such as at least one disc cutter, configured to bore the tunnel 12 by crushing rock as the TBM 10 advances in a forward direction. The disc cutters can produce high penetration rates with a long cutter life. The high penetration rates obtainable are the result of high individual cutter loading, optimum cutter spacing for the rock type involved, proper selection of disc cutting edge, and a suitable pattern for the disc cutters. Foams and water injection can also be provided for use in the cutter head 16 to reduce the amount of dust being created or reduce the adhesion of excavated materials.

Figure 3:
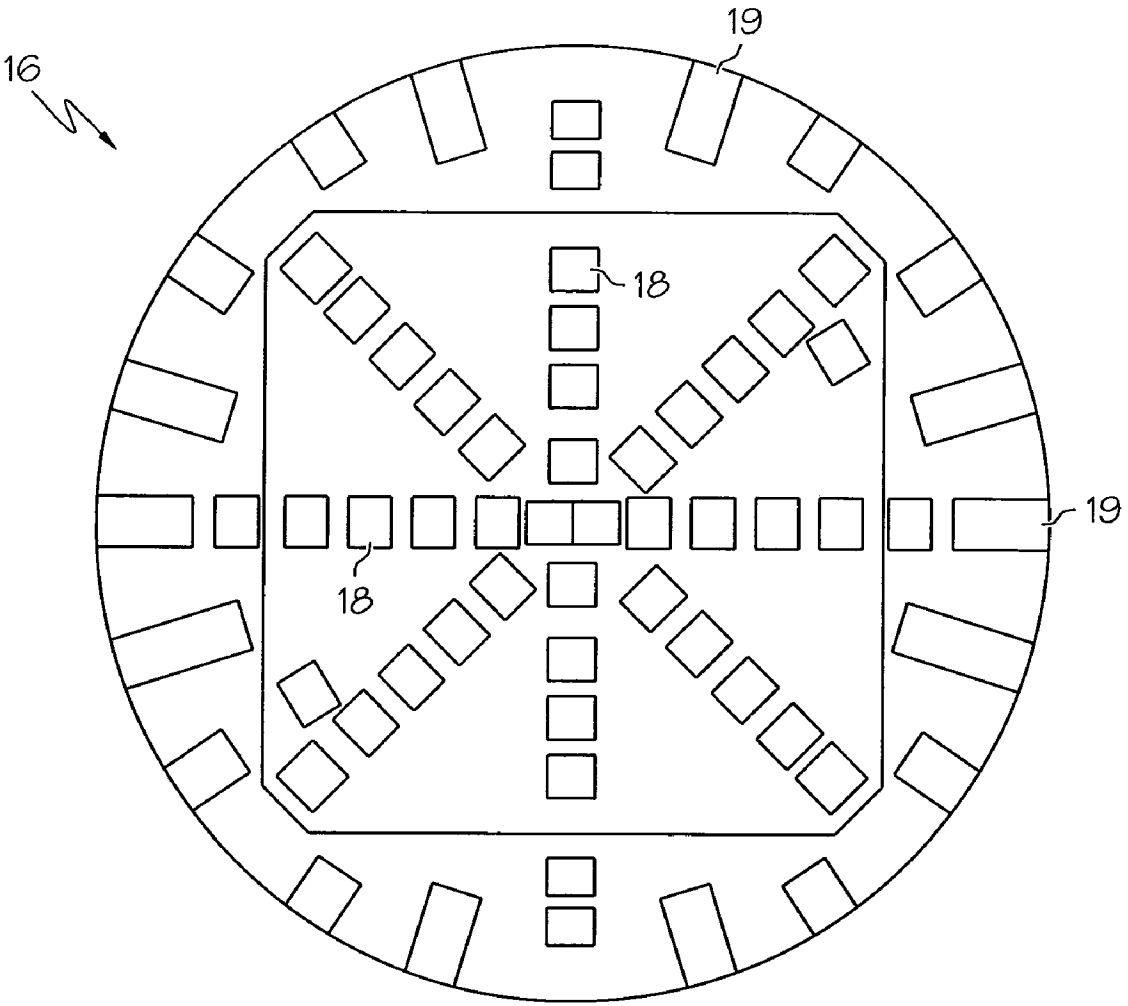
FIG. 3 is a front view of the cutter head of FIG. 2 that includes a cutting mechanism.

As shown in FIG. 3, an example cutter head 16 that includes cutting mechanisms 18 such as twin disc center cutters, face cutters, and gage cutters is shown. The cutter head 16 can be comprised of a number of examples. There can be any amount of disc cutters, though in one example there can be 41 disc cutters and in another example there are 69 disc cutters. The maximum cutter load for the disc cutters can be 311 kN. The TBM 10 cutter head 16 can be driven by eight (8) VFD electric drives. Each of the motors can be powered by a dedicated frequency inverter, such as the VFD. The inverters can communicate on a common data network so as to ensure stability and equal torque loading among the motors. Inoperative VFDs and/or motors can be bypassed to allow continued operation of the TBM 10.

It is appreciated that the cutter head 16 can include buckets 19 for removing material from the tunnel 12. The buckets can be spaced radially about the cutter head 16 and can handle high penetration rate volumes of cuttings. Direct dump buckets can also be provided for improved face control and reduced raveling. Each of the buckets 19 can be bolted on for easy replacement.

The cutter head 16 can use replaceable abrasion resistant wear bars and wear plates. The cutter head 16 can have a variable speed control, such as through the use of a variable frequency drive, to cope with changing geology and high start-up torque. The cutter head 16 can further include at least one stabilizer, such as two stabilizers, for smoother operation and longer cutting life and for reducing the vibration wear on the cutter head 16. A flat portion of the cutter head 16 provides basic face stability while cutting. It can include a heavy steel welded structure in six sections for ease of transport and assembly. The cutter head 16 utilizes recessed back loading cutters allowing an exceptionally smooth face, which has proven very effective in broken or blocky rock. This surface will be provided with a pattern of hard facing to minimize wear of the faceplates while boring in the foreseen geological formations. The disc cutter can produce high penetration rates with long cutter life. The high penetration rates obtainable are the result of high individual cutter loading and optimum cutter spacing for the rock type involved and correct cutter profile (i.e. correct design of the cutter head 16 considering optimal cutter spacing). The disc cutter can also include a replaceable cutting ring, an insert type bearing, metal-to-metal seals, and lubrication. Multiple rings may be used successively on one hub assembly before hub maintenance is required. The rings are shrink-fitted to the hub and are secured with a locking ring. The cost of a removable ring is about one tenth the cost of a complete cutter assembly with ring. Discs can be provided in a number of different profiles, to address different rock conditions and for optimum performance at gage, face or center positions.

A muck handling system of the TBM 10 can be provided that includes at least one muck bucket on the perimeter of the cutter head 16, a muck chute, and a conveyor 20 shown in FIG. 1. The conveyor can also be situated within the main beam 80. A muck ring can be provided to assure efficient loading at a low cutter head RPM. The radial muck buckets 19 catch some muck as it is formed and scoop the rest up from the bottom of the tunnel 12. The muck moves through the muck chutes of the cutter head 16 and is dropped onto the machine conveyor 20 through a chute in a cutter head support assembly 36. The conveyor 20 loading chute is located inside the rotating cutter head 16; therefore, any spillage at this point falls into the cutter head 16 muck chutes and is returned to the conveyor 20. The machine conveyor 20 transports the muck to the trailing equipment. The conveyor 20 assembly can be retracted for easier access to the cutter head 16 for cutter changes. The buckets can transport the material on to the conveyor 20 through the interior of the first shield, the second shield, and the third shield to the rear portion of the tunnel. Muck chutes can be provided to guide the muck into a muck hopper. It is also desirable to provide efficient broken rock removal from the face area to the belt of the conveyor 20. The main beam 80, shown at least in FIG. 9, can also have an access hole where blocks can be disposed to a jaw crusher, which then transports the crushed material to the conveyor 20.

To change cutting mechanisms, the conveyor 20 slides back from the head of the TBM 10, allowing access. A mounting point for a hoist and sling is designated for each cutting mechanism. With the sling in place, the cutting mechanism is extracted and then lowered to the bottom of the cutter head 16. Each of the face cutters can be changed from within the cutter head 16, such as behind the front face of the cutter head 16, and from in front of the cutter head 16. However, the center cutting mechanisms, such as a two center cutters, are only replaceable from within the cutter head 16. The inspection of cutter rings can take place from within the cutter head 16.

The cutter head 16 is designed to reduce torque requirements during start-up and boring in unstable ground. A standoff distance of 100 mm between the rock face and the plating of the cutter head 16 allows passage of crushed rock to flow into the buckets while at the same time, this provides for minimal protrusion of the cutters when starting the cutter head 16 in the crushed or unstable ground. At the periphery of the cutter head 16, this standoff distance is reduced to 60 mm to reduce friction even further and to minimize disturbance of the ground pressing onto the perimeter. The cutter head 16 can have a smooth, low cutter profile and radial muck scoops with shallow relief.

The cutter head 16 can be provided with at least one dust shield located at the cutter head support assembly 36 around the conveyor 20. The dust shields are configured to control the amount of dust. Circulation in the face area is provided by fresh air ducts into the cutter head 16 cavity, and suction through the conveyor 20 tube. A ventilation system can be provided that includes fresh air fans, booster fans, and flexible ducting to force fresh air from the surface to the location at the rear of a third shield 34, such as to an operator station 120, shown in FIG. 1. A single axial fan and silencer can be provided for boosting incoming fresh air pressure to force it through the backup vent ducting. A system of suction and fresh air ventilation ducts, fans and scrubber can be provided on the backup system to handle air movement around the equipment, and scrubbing of the air as required during boring of the tunnel 12. Through careful attention to air flows, the dust is confined to the cutter head 16 area from which it is drawn through the ventilation ducting to the air scrubber/filter supplied with the backup system. The air scrubber, fans and silencers can be mounted on the back-up system. Two ducting cassettes can also be included. The ducting cassette system allows an advance of approximately 100 m before having to replace the cassette. The ducting cassette can be stored in a variety of locations within the TBM 10. There can be sufficient overlap of the incoming fresh air line and the out-going dust scrubber exhaust.

A nominal-boring diameter of the TBM 10 is related to the outside diameter of the cutter head 16, shown in FIG. 3, the ground-to-shield clearances and the shield-to-segment clearances (i.e. an internal clearance), plus allowances for steering and cutter wear. An inside clearance to the shields can be 50 mm, with a shield thickness of 40 mm, and an allowance for steering and cutter wear. It is appreciated that the TBM 10 can be designed for various sized tunnels 12 and that these dimensions are only presented as one example of the relative proportions of the structure.

It is appreciated that the TBM 10 can be designed so that the cutter head 16 can provide an overbore capability. This allows additional space above the front shield so that if squeezing ground is present there is additional time available to move the shield. The overbore capability can help to reduce the risk of trapping the TBM 10 by allowing the installation of yielding ring beams for extreme squeezing ground conditions. In addition, a first shield 30, a second shield 32, and a third shield 34 can be designed again as a step down type; their external diameter being further reduced. The cutter head 16 can have a larger diameter than either the first shield 30, the second shield 32, or the third shield 34. It is also possible to use shim plates on the cutter head 16 to provide an additional overbore of 25 mm on the radius if required.

Figure 4B:
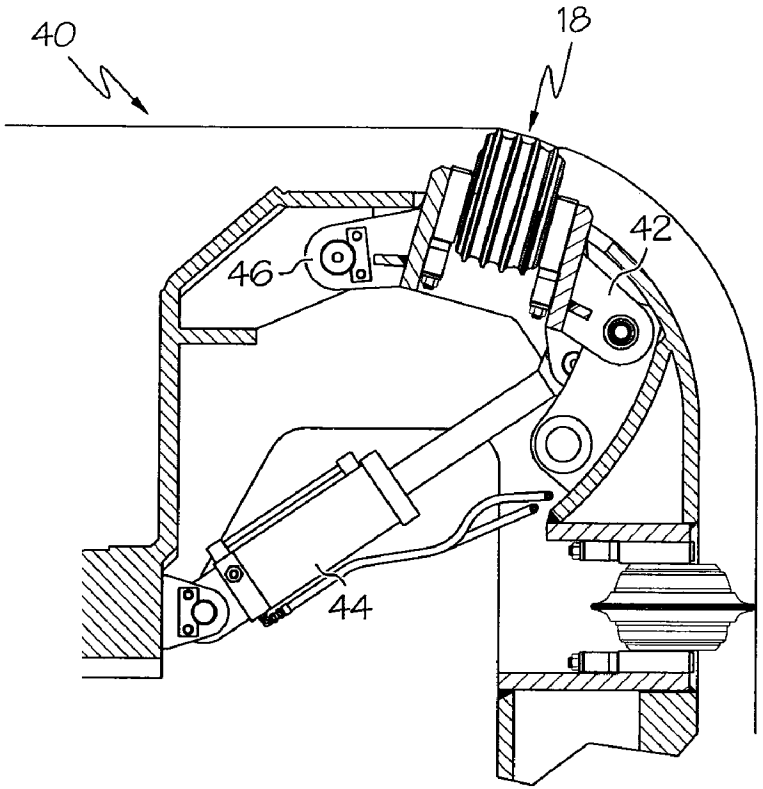
FIG. 4B is a front view of the cutting mechanism of FIG. 4A in a second position.
Figure 4A:
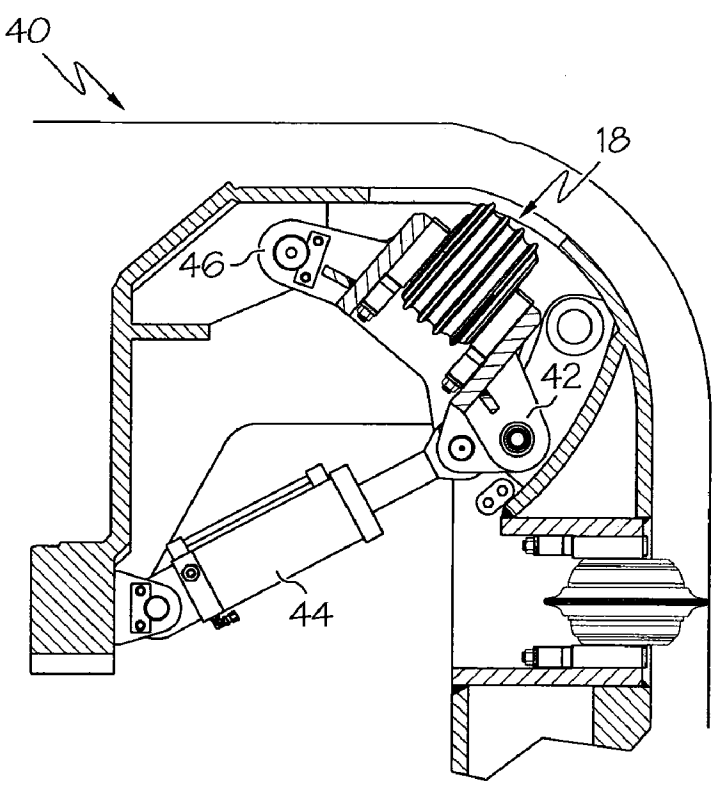
FIG. 4A is a front view of the cutting mechanism of FIG. 3 in a first position.

An overbore capability can also be provided by allowing the cutter head 16 to change diameters during tunneling. As shown in FIG. 4A and FIG. 4B, the cutter head 16 can provide the overbore capability by providing at least one cutting mechanism 18 that is configured to change positions to expand a boring diameter of the cutter head. For example, the cutting mechanism 18 can include an overbore assembly 40 configured to move the cutting mechanism away from the center of the TBM. The overbore assembly 40 can include a fixture 42 and a hydraulic mechanism 44. The fixture 42 is configured to house the cutting mechanism 18. The hydraulic mechanism 44, such as a cylinder, is configured to push the fixture 42 holding the cutting mechanism 18 from a first position (FIG. 4A) to a second position (FIG. 4B). The fixture 42 can be moved relative to a fixed point 46, though in other examples, the entire fixture 42 can be moved by the hydraulic mechanism 44. In one example, the bore diameter can be increased 500 mm. The cutter head 16 can change diameters during operation by the use of a number of overbore assemblies 40, such as ten, which are placed about the cutter head 16.

A cutter head support assembly 36 can be located between the cutter head 16 and the first shield 30, as shown in FIG. 2. The cutter head support assembly 36 can house a power transmission mechanism for the tunnel 12 boring machine. The cutter head support assembly 36 provides a stable structure for mounting the cutter head 16 and the cutter head support assembly 36 can include a portion for receiving the cutter head 16. The cutter head support assembly 36 can also function as an additional shield for the TBM 10. The cutter head support assembly 36 is the principal structural element of the machine which houses a main bearing, a bull gear, a main drive assembly (e.g. motors and gear reducers). The TBM 10 thrust and torque is transmitted through the cutter head support assembly 36. The machine can use a large diameter high capacity roller bearing which accepts both radial and thrust loading of the cutter head 16. The main bearing can have a triple axis and a dry sump, circulating oil lubrication system which supplies oil to the main bearing. Oil being supplied to the bearing and gear are passed through cartridge type filter elements. Oil returning from the bearing/gear cavity is passed first through a magnetic strainer, then through cartridge type filter elements. Both supply and return cartridge filters are mounted in tandem with switch-over valves which allows maintenance of filter elements during operation of the machine. Electronic monitoring of the main lubrication system is provided, with information provided to the operator and failsafe protection.

The main bearing can be sealed with the latest sealing arrangement utilizing a grease purged labyrinth system. Both the inner and outer sealing systems consist of a series of large cross-section, high deflection lip seals. The lip seals are mounted within the bores of machined parts with the lips extending inward. The shafts against which the seal lips ride are covered (shrink fit) with a very high tensile strength, abrasion resistant alloy steel band. The alloy steel band provides maximum shaft life, and can be replaced during rebuilding between projects for far less cost than new shafts. The orientation of the seal passage ways (labyrinths) are carefully controlled to further protect against the ingress of contaminants. The seals themselves are flushed and lubricated with a continuous but very, very low volumetric flow rate of hydraulic oil or grease. Lubricants are dispensed through a positive lubricant distributor. Electronic monitoring of the seal lubrication system is provided, with information provided to the operator and failsafe protection. The labyrinth on the outside of the seals is flushed with water. And, finally, the actual main bearing/gear cavity can be maintained under a small positive air pressure, if required, to provide further protection against ingress of contaminants.

Lubricants are dispensed through a positive grease distributor. The lubrication oil system is continually filtered and the oil level is monitored electronically and visually. The system provides constant oil circulation and filtration and is a dry sump system. The dry sump system means that the bearing and gear are not submerged in potentially contaminated oil, but are constantly flushed with fresh filtered oil. The system includes a lubricant tank fitted with pumps, supply filtration and return oil filtration. Lubricant is fed to positive displacement distribution blocks which insure that the required flow rate of lubricant is distributed to each lubrication point. The system includes warning and fault indicators for level, temperature and flow. Indicators give visual warnings on the operators console and automatically shut down TBM 10 thrust and cutter head 16 rotation at pre-set limits.

Figure 5:
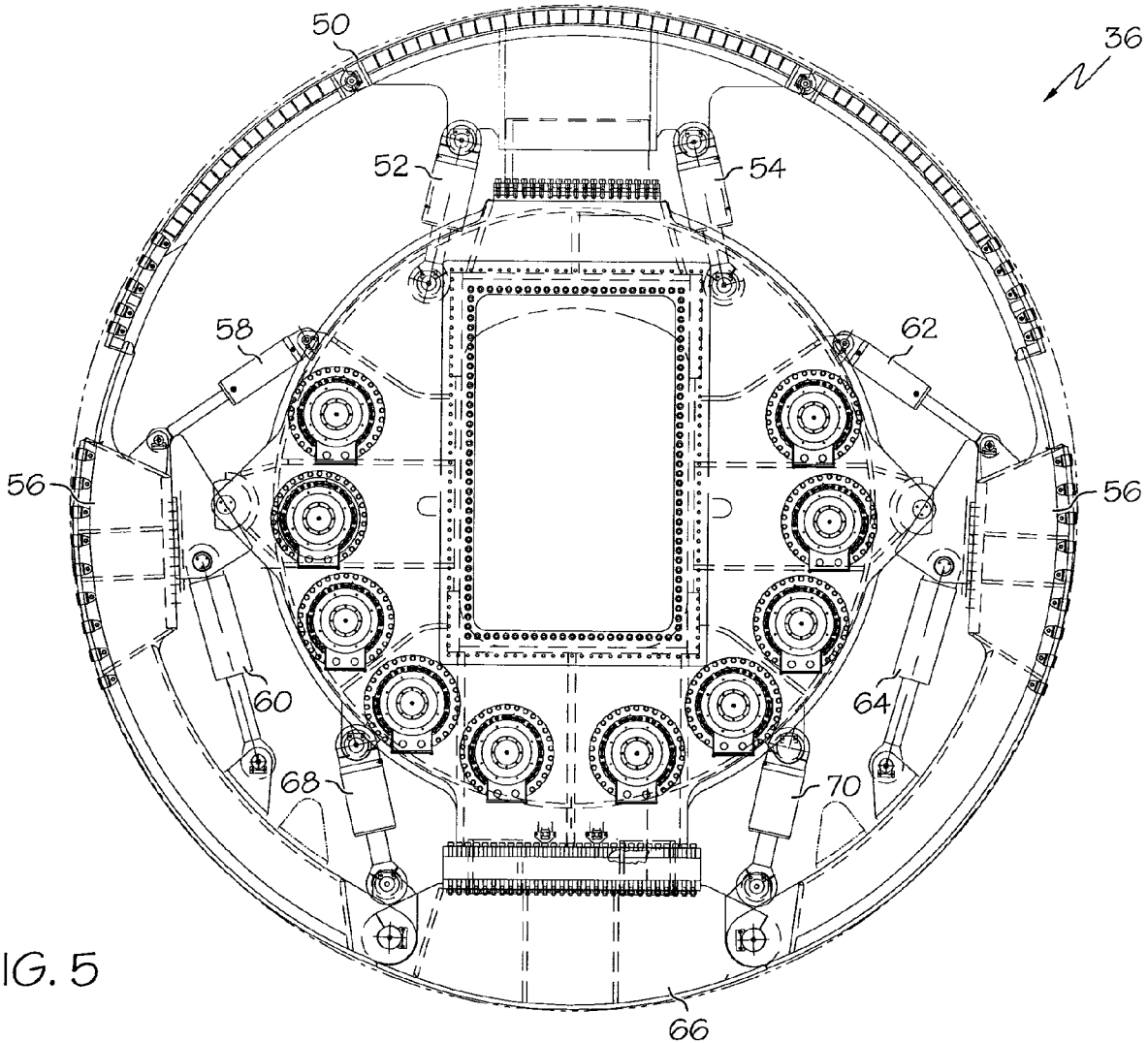
FIG. 5 is a front view of the cutter head support assembly of FIG. 2.

In FIG. 5, a front view of the cutter head support assembly 36 is shown. The cutter head support assembly 36 can include a roof support assembly 50 and can house the drive assemblies 51. The roof support assembly 50 is configured to include a first extendible support 52 and a second extendible support 54 to move various portions of the roof support assembly 50. It is appreciated that the number of extendible supports can be changed in other examples. The extendible supports 52, 54 are configured to move the roof support assembly 50 upwards in contact with the tunnel wall 14 to provide support for the tunnel wall 14 immediately behind the cutter head 16. The cutter head support assembly 36 can further include at least one side support assembly 56. The side support assembly 56 is similar to the roof support assembly 50 in that each side support assembly 56 can have a number of extendible supports 58, 60, 62, 64. The cutter head support assembly 36 can also include at least one front support assembly 66. The front support assembly 66 can also include a number of extendible supports 68, 69. The front support assembly 66 is typically only placed in an extended position when the overbore capability is activated. It is appreciated that the right half of FIG. 5 shows some of the extendible supports (54, 62, 64) in their extended positions to show the amount of movement in one example for the roof support assembly 50 and the side support assembly 56.

In any of the examples, the TBM 10 can include at least the roof support assembly 50 for applying forces to the recently drilled tunnel 12 right near the face of the cutter head 16. The first region that is adjacent to the cutter head 16 can include the roof support assembly 50. The roof support assembly 50 applies pressure to the crown of the tunnel 12 delaying loosening of faulted rock, raveling etc. This way, the ground is supported in multiple places, as opposed to being supported just at the front, or the face of the cutter head 16, and the rear portion of the TBM 10. The roof support assembly 50 is configured to push upwards against the ground to delay the slacking of the ground. The roof support assembly 50 can be part of the cutter head support assembly 36 in one example though it is appreciated that it can also be in other locations. The roof support assembly 50 can include pockets within each roof support portion for receiving steel bars, or other durable bars, within the roof support shield. The steel bars can help to provide additional rigidity for the roof support.

Figure 6:
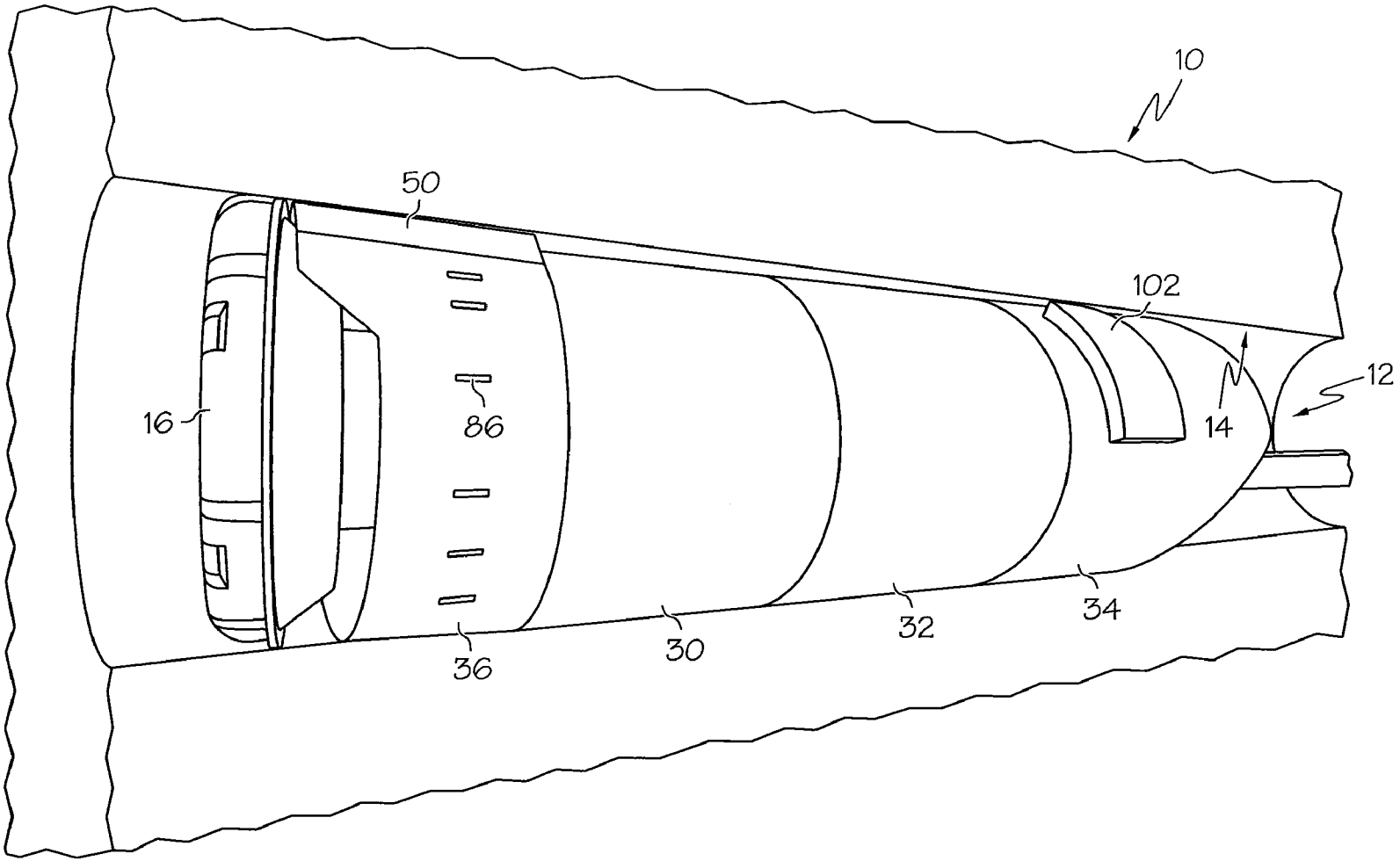
FIG. 6 is a side view of the example tunnel boring machine of FIG. 1 in double shield mode.

As shown in FIG. 6, the roof support assembly 50 can be part of the cutter head support assembly 36, thus making the cutter head support assembly 36 an "active" shield, as opposed to a "passive" shield. When the roof support assembly 50 is part of the cutter head support assembly 36, the roof support assembly 50 can be hinged and hydraulically expandable so that it can be pressed outward to the ground, immediately behind the cutter head 16. This can provide immediate ground support. In addition, the cutter head support assembly 36 can support the ground behind the cutter head 16 and still aid in the steering of the TBM 10. In contrast, a typical double shield TBM can be substantially clear of the tunnel wall 14, and does not provide any ground support unless the ground of the tunnel wall 14 collapses a given amount.

As shown in FIG. 6, the TBM 10 is shown while in the double shield mode. The TBM 10 includes the cutter head 16 and a first shield 30 is located behind the cutter head 16 about the perimeter of the cutter head 16, which in this example is about the circumference of the cutter head 16. The first shield 30 extends in a longitudinal direction away from the cutter head 16. A second shield 32 is located behind the first shield 30. A third shield 34 is located behind the second shield 32. The first shield 30 can move telescopingly relative to the second shield 32. It is appreciated that the first shield 30 can move within the second shield 32 or the second shield 32 can move within the first shield 30. The second shield 32 can be attached to the third shield 34 with an articulated joint. The articulated joint provides flexibility in the shield body which is necessary for steering the TBM 10 through curves. The third shield 34 is located further from the cutter head 16 than the first shield 30 or the second shield 32. Any of the shields 30, 32, 34 can be comprised of a plurality of different portions. For example, the third shield 34 can include a gripper shield and a tail shield. It is appreciated that the first shield 30, the second shield 32, and the third shield 34 can provide protection for workers and operators in an interior of the tunnel boring machine. Each of the shields 30, 32, 34 can be made from a variety of materials and can have a variety of shapes.

Figure 7:
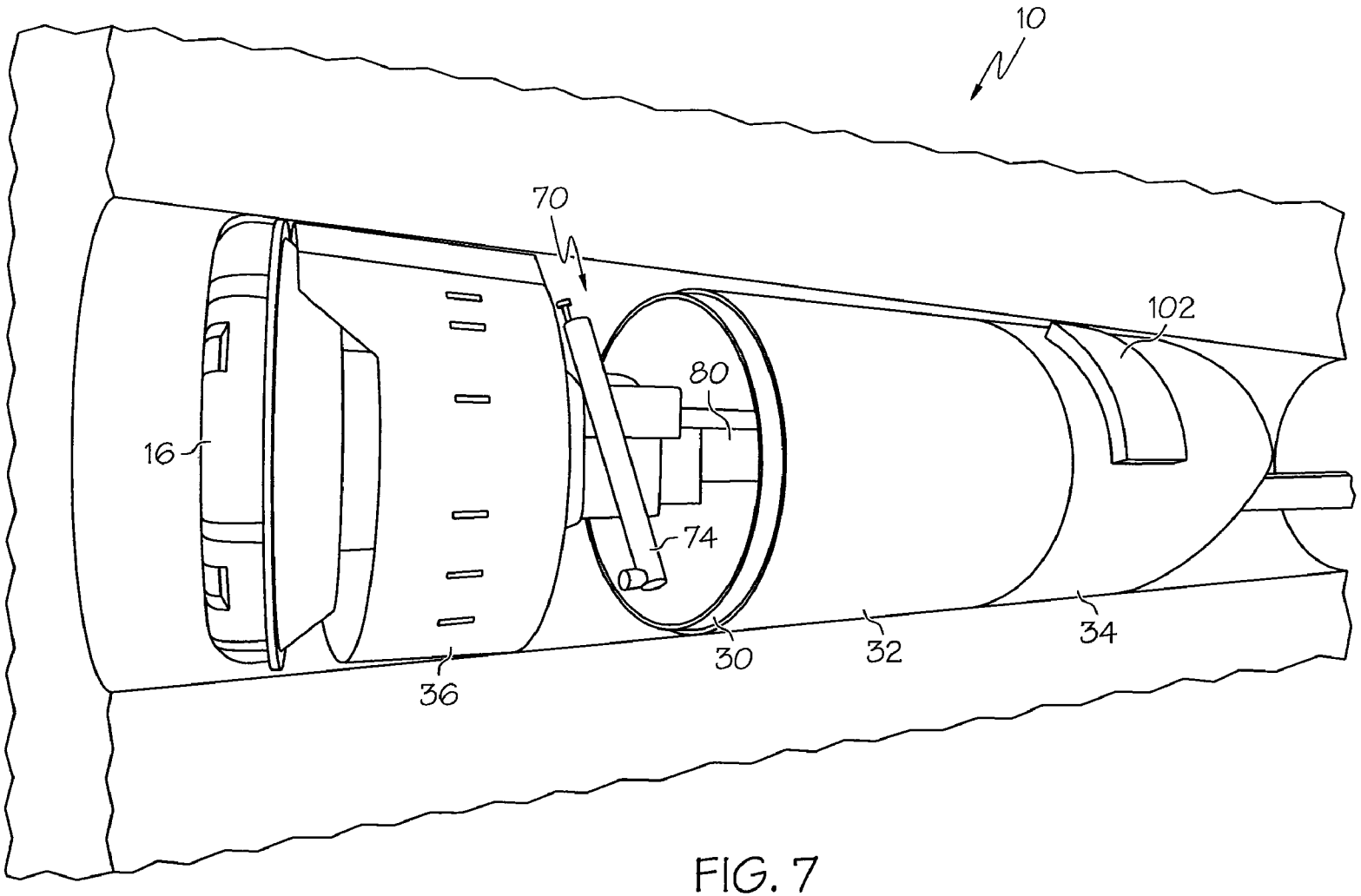
FIG. 7 is a side view of the example tunnel boring machine of FIG. 6 with a first shield retracted within a second shield.

As shown in FIG. 7, the TBM 10 is shown while in an open mode that exposes an unlined tunnel wall 14. In FIG. 7, the first shield 30 can be retracted relative to the second shield 32, such as by the first shield 30 retracting within the second shield 32. In other examples, the first shield 30 can be larger than the second shield 32 and can be retracted around the second shield 32. A ground conditioning work zone 70 is located immediately behind the cutter head 16 or the cutter head support assembly 36, where the ground conditioning work zone 70 is located within the first shield 30. As the diameter of the tunnel 12 increases, the potential for ground collapse above and in front of the cutter head 16 significantly increases. However, the ground conditioning work zone 70 can provide approximately 2.5 meters of exposed rock and soil on an unlined tunnel wall 14 in which to activate probing devices, install various types of ground supporting materials, or to pre-condition the rock ahead of the machine. The first shield 30 is configured to be retracted within the second shield 32 to provide access to the interior of the tunnel 12 for the ground conditioning work zone 70 to install at least one ground support device 72, when necessary or when determined by an operator. In other examples, the first shield 30 is configured to be retracted around the second shield 32. The ground conditioning work zone 70 utilizes space that is created, at least in part, by placing the drive motors for the TBM 10 in the lower half of the tunnel 12. In addition, as will be discussed, there are no second propulsion mechanisms 118 in direct contact with the cutter head 16. Thus, additional space and access to the tunnel walls 14 is created by the absence of the second propulsion mechanisms 118. Retracting the first shield 30 within the second shield 32, while maintaining the position of the cutter head 16, provides access for the ground conditioning work zone 70 to the interior of the tunnel 12 such that the tunnel walls 14 can be exposed for inspection.

Figure 8:
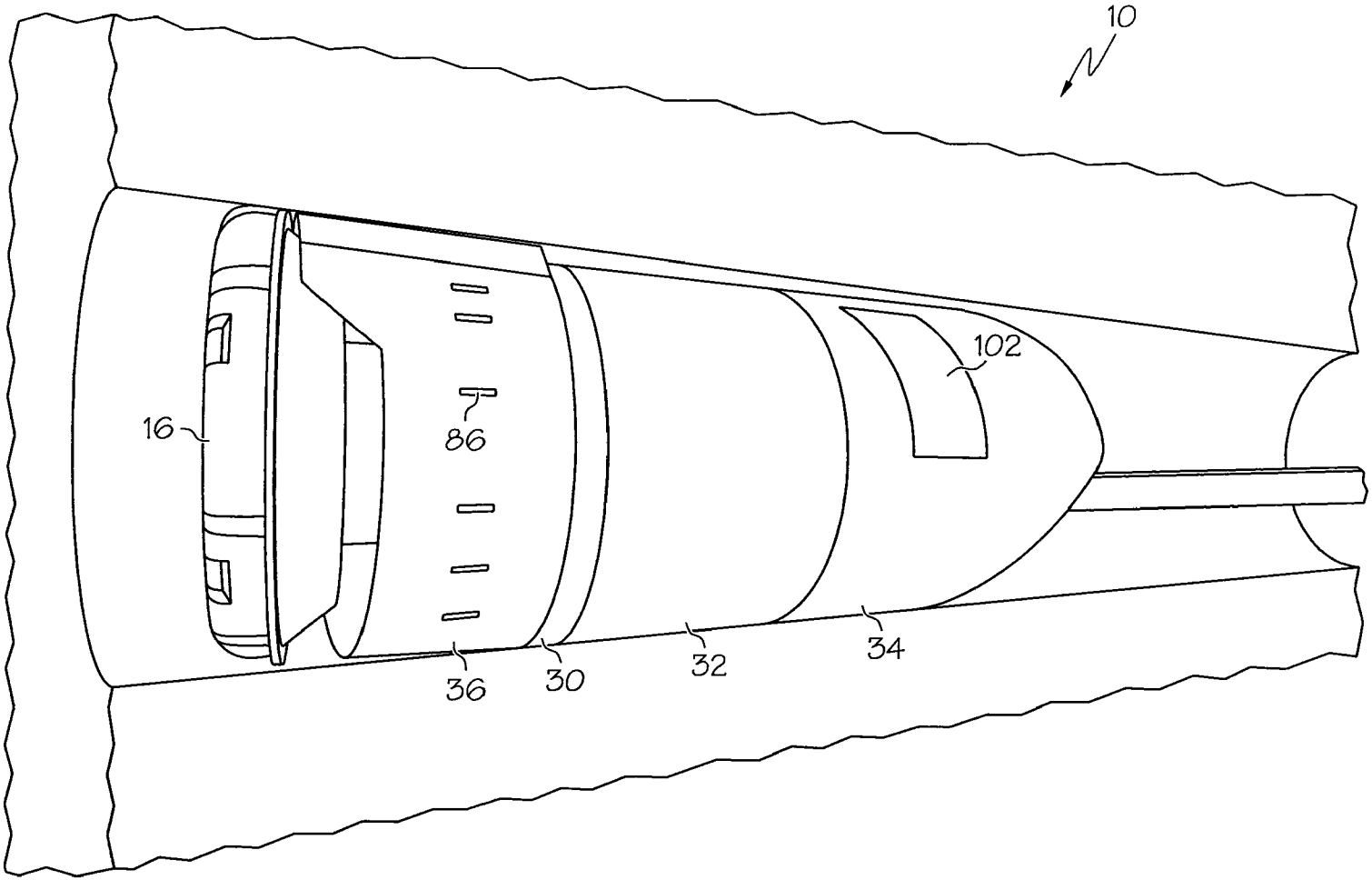
FIG. 8 is a side view of the example tunnel boring machine of FIG. 1 in single shield mode.

As shown in FIG. 8, the TBM 10 is shown while operating in a single shield mode. The single shield mode can be chosen to reduce the amount of friction on the tunnel walls 14 due to a shorter length than the double shield mode. In the single shield mode, the cutter head 16 is retracted along with the first shield 30 towards the second shield 32. A substantial portion of the first shield 30 is received within the second shield 32.

Figure 9:
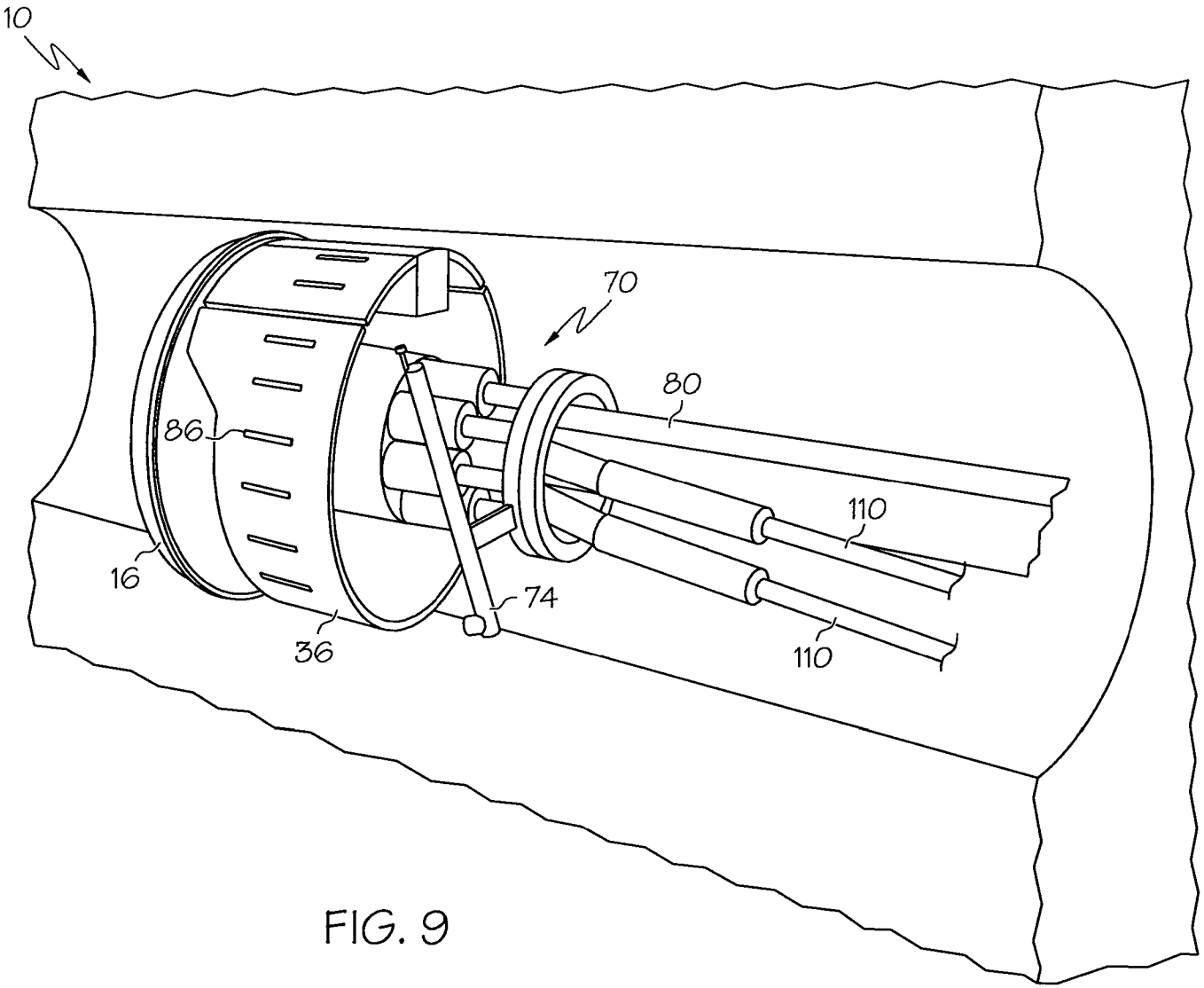
FIG. 9 is a side view of the example tunnel boring machine of FIG. 1 in an open mode with a first shield and retracted within a second shield to show a ground conditioning work zone and to show an arm assembly in a first position.

As shown partially in FIG. 9, the TBM 10 can have a main beam 80 located within an interior of the TBM 10. The main beam 80 can be configured to provide a reaction of a thrust force of the cutter head 16 and to provide rigidity and control for the TBM 10. It is appreciated that the main beam 80 can also be present within the TBM 10 in the other drawings. In the ground conditioning work zone 70, various structures can be provided for working on the tunnel walls 14 and applying at least one ground support device 72, as discussed with regards to FIGS. 9-11. For example, the ground conditioning work zone 70 can include at least one arm assembly 74 that is configured to provide ground detection and each arm assembly 74 can install at least one type of ground support device 72. It is appreciated that the ground conditioning work zone 70 can include a plurality of arm assemblies 74 where each arm assembly 74 can have a number of different ground support devices 72 attached to it for performing different ground support operations. Alternatively, each arm assembly 74 can install a single ground support device 72 or can only have a probing device for probing the terrain. The arm assembly 74 is supported by a main beam 80 (shown in FIG. 9) of the TBM 10. The ground conditioning work zone 70 provides an ability to place temporary lining, such as a ring beam 92 shown in FIG. 13, that can yield over time from within the tunnel 12 and to perform investigative drilling close to the face of the cutter head 16. Providing various ground support devices 72 in the ground conditioning work zone 70, in front of the second shield 32 and in front of the third shield 34, can decrease the chance of the ground collapsing and trapping the second shield 32 and the third shield 34. The arm assembly 74 can be movably attached to the main beam 80. As shown in FIG. 9, the arm assembly 74 is shown in a first position. The arm assembly 74 is configured to be moved into the second position of FIG. 10.

Figure 10:
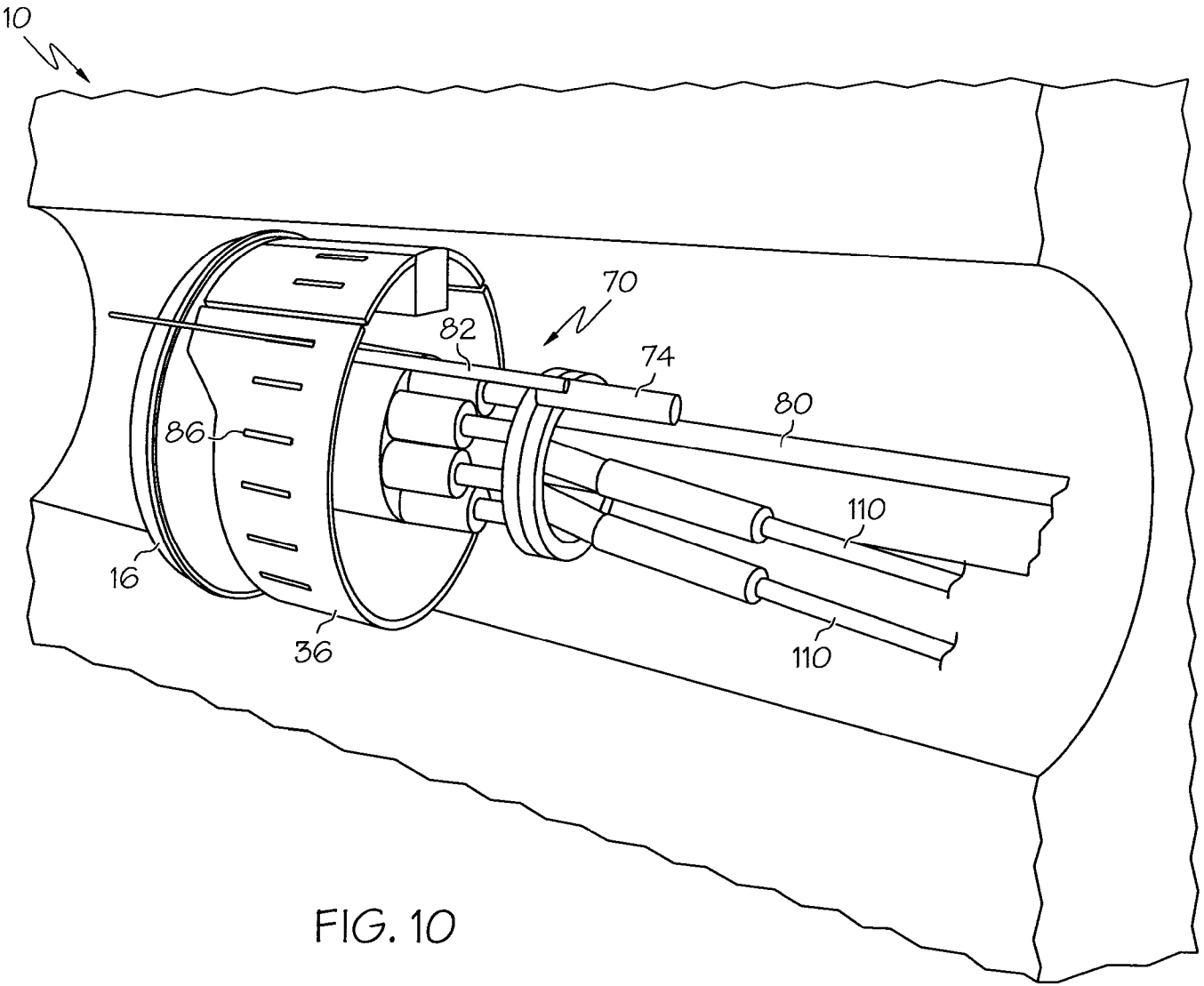
FIG. 10 is a side view of the example tunnel boring machine of FIG. 9 with the arm assembly in a second position for probe drilling into the tunnel.

As shown in FIG. 10, the arm assembly 74 can include at least one probing device, such as at least one probing drill 82 or other reconnaissance device, for drilling at least one hole 84 to probe the terrain in front of the cutter head 16. The probing drill 82 can probe the terrain ahead of the TBM 10 to determine ground conditions and water inflows. Alternatively, the probing device can be used to probe ground above or below the TBM 10. It is appreciated that the arm assembly 74 can also include other advance ground detection devices and probing devices to monitor conditions in advance of excavation. The probe drills 82 can be mounted on custom designed fixtures which allow them to be used to probe 360 degrees around the perimeter of the tunnel, such as the circumference in this example, or the probe drills 82 can extend through the cutter head 16 in several positions. A single 360 degree track-ring can be mounted to the main beam 80 for the probing drill 82 to rotate about the main beam 80. The feeds for the probe drills 82 are mounted on a traveling carriage which can move around the track-ring. The cutter head support assembly 36 is fitted with apertures 86 at approximately a 7-degree lookout angle (measured from tunnel 12 centerline). It is also appreciated that the apertures 86 can be located at other angles including providing apertures 86 that are located perpendicularly without any angle relative to the cutter head 16.

Figure 11:
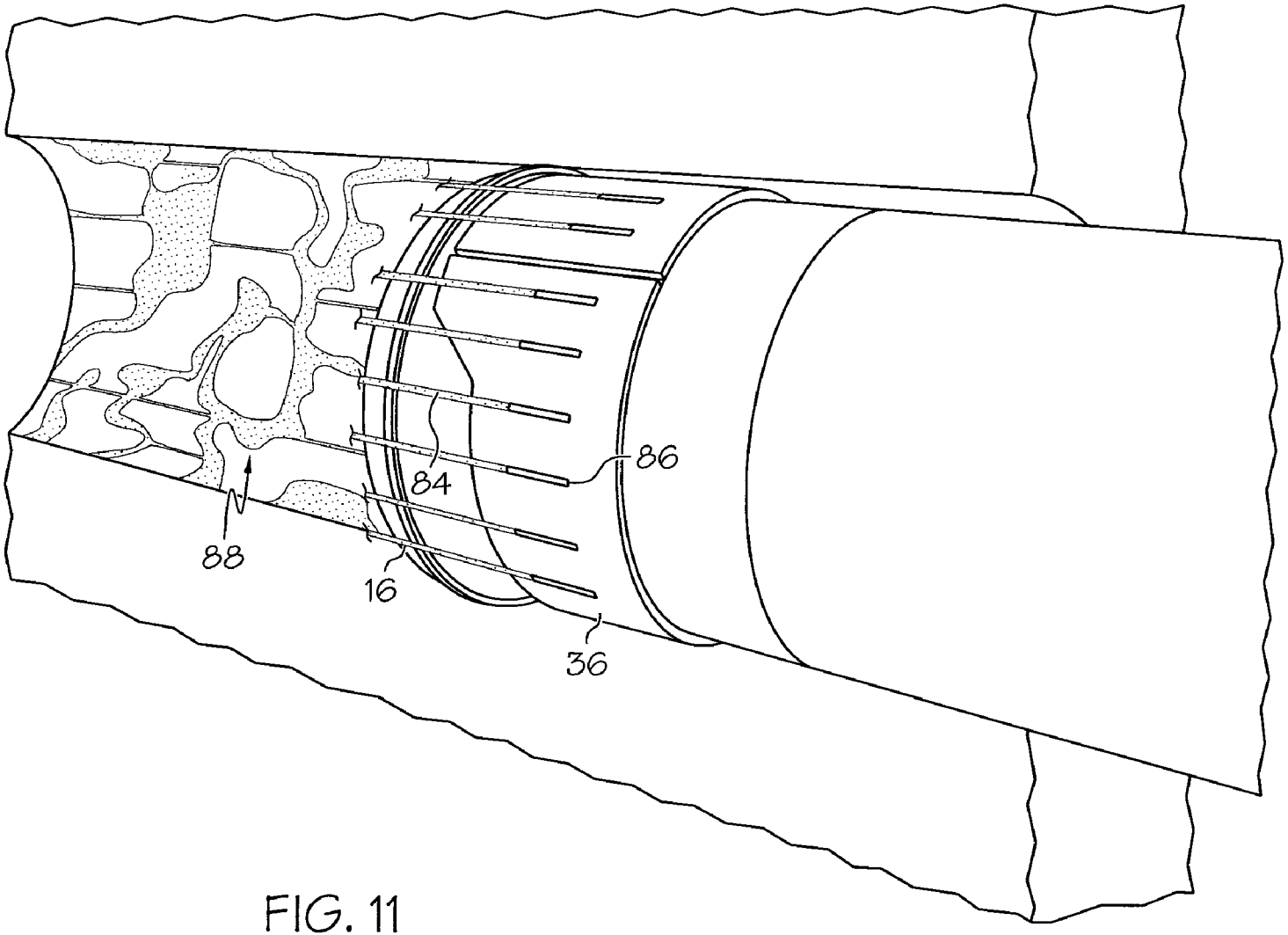
FIG. 11 is a side view of the example tunnel boring machine of FIG. 10 with the arm assembly filling the holes with a ground conditioning agent.

One of the purposes of the all-conditions tunnel boring machine 10 is the premise that nearly all geological conditions contain unstable rock or soil conditions. Such unstable conditions should be detected in advance boring and preconditioned prior to advancing the TBM 10. Preconditioning and/or pre-treatment of rock in advance of the TBM 10 reaching the rock can be performed by the arm assembly 74. For example, the probing drill 82 can be a hydraulic percussions drill. In some examples, the probing drill 82 is a part of the arm assembly 74. A ground conditioning agent, such as grouting or other chemicals that can alter, strengthen, or bond the ground, can then be used to fill the holes 84 formed by the probing drills 82. It is appreciated that other ground conditioning agents can be used to fill the holes 84 formed by the probing drills 82. The grouting can include bentonite or other polymers. The grout, which can be comprised of cement, is used to restore the integrity of the rock. The ground conditioning agent can seal off ground water. Ground conditioning agents can be applied at the end of each stroke of movement, if the ground is not good. Of course, ground conditioning agents can be applied as needed based on the conditions encountered in the tunnel 12. For example, as shown in FIG. 11, the arm assembly 74 can be configured to fill at least one of the holes 84 with a ground conditioning agent 88 upon the detection of unstable ground, the detection of water, or the detection of weak rocks. The ground conditioning agent 88 and the drill holes 84 can be applied at a 7° angle relative to a longitudinal axis of the main beam 80. Other angles, including larger angles, can be used for the drilling and application or insertion of at least one ground conditioning agent. The drill holes 84 can have a specific pattern around the periphery of the tunnel to maximize effectiveness. The pattern can be a fan around the periphery of the tunnel. In addition, the pattern of drill holes 84 can be arranged directly through the cutter head 16 and into the tunnel 12. If pre-excavation ground conditioning agents are needed, the amount of the ground conditioning agent 88 needed will be less than in prior art designs because the source of the ground conditioning agent 88 is located closer to the face of the cutter head 16. By being placed closer to the cutter head 16, the angled drilling lines will be closer vertically to the tunnel 12 and less of the ground conditioning agent 88 will be needed to travel the same horizontal distance. This provides a more "useable" probing drill 82 length because the holes 84 drilled from the forward position do not diverge as much from the longitudinal axis of the bored tunnel 12. By placing the pattern of drill holes 84 closer to the face of the cutter head 16, an improved density of the holes 84 can be achieved. Various densities and arrangements for the drill holes 84 can be provided and FIG. 11 shows just one example of possible drill holes 84.

The cutter head support assembly 36 can include a plurality of apertures 86 that are configured to receive a portion of the arm assembly 74 for drilling the at least one hole 84 for probing the terrain in front of the cutter head 16. The apertures 86 are also configured to receive at least one ground conditioning agent for treating the weak rock. The ground conditioning agent, such as grouting, also can travel through the apertures 86 of the cutter head support assembly 36. It is appreciated that the apertures 86 can be provided on the first shield 30 and that the cutter head support assembly 36 represents just one example of structure that is configured to allow probing drills 82 and ground conditioning agents to be injected near the cutter head 16. As the arm assembly 74 can rotate about a central portion, such as the main beam 80, the ground conditioning agent and the probing drills 82 can be applied from various positions. The arm assemblies can thus rotate about to drill through various apertures 86 of the cutter head support assembly 36. Thus, the arm assembly 74 can probe and pre-treat rock on an angled direction of 360° of the tunnel 12 perimeter in advance of the front of the tunneling machine. In one example of the probing drills 82, the drill carriages are powered around the ring to move into position, aligning with the desired drill guide tube. The probing drill 82 feeds are then extended forward as required and the appropriate angle is set, so that the drill bit and steel enters the drill guide tube. Due to the improved density of the arranged holes 84, as described above, the ground conditioning agent 88 is more likely to result in strengthening the walls of the tunnel 12 at locations ahead of the cutter head 16.

Figure 12:
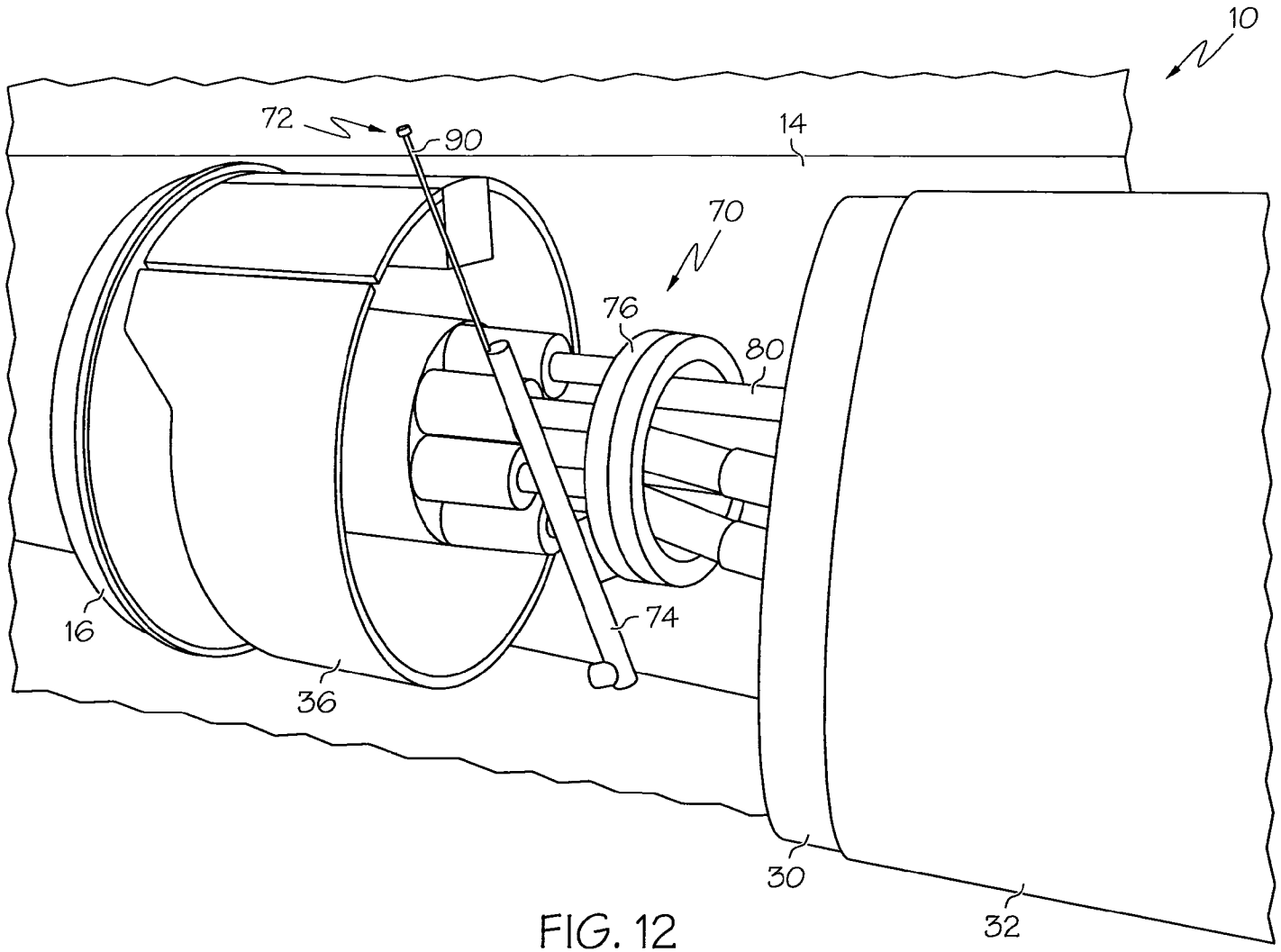
FIG. 12 is a side view of the example tunnel boring machine of FIG. 9 with the arm assembly installing the ground support device of a bolt.

Examples of ground support devices 72 that can be utilized in the ground conditioning work zone 70 include bolts 90, ring beams 62, mesh structures 64, and shotcrete 94. Each ground support device 72 provides support behind the cutter head support assembly 36 to help ensure that the shields 30, 32, 34 of the TBM 10 do not become trapped due to a cave-in. As shown in FIG. 12, the ground conditioning work zone 70 can include one example of ground support device 72 by placing a bolt 90 in the tunnel wall 14 to secure the ground. One example of a rock bolt 90 is a steel rod that has an anchor mechanism that is used to support unstable rock or to attach items to the hard rock. The rock bolts 90 can also be used in combination with the ground conditioning agent feature of the arm assembly 74 to secure the rock bolt into place where the ground conditioning agent can be an epoxy cement. As shown in FIG. 12, the arm assembly 74 can include a circular ring 76 mounted on the main beam 80 that is configured for allowing the arm assembly 74 to rotate about the main beam 80.

Figure 13:
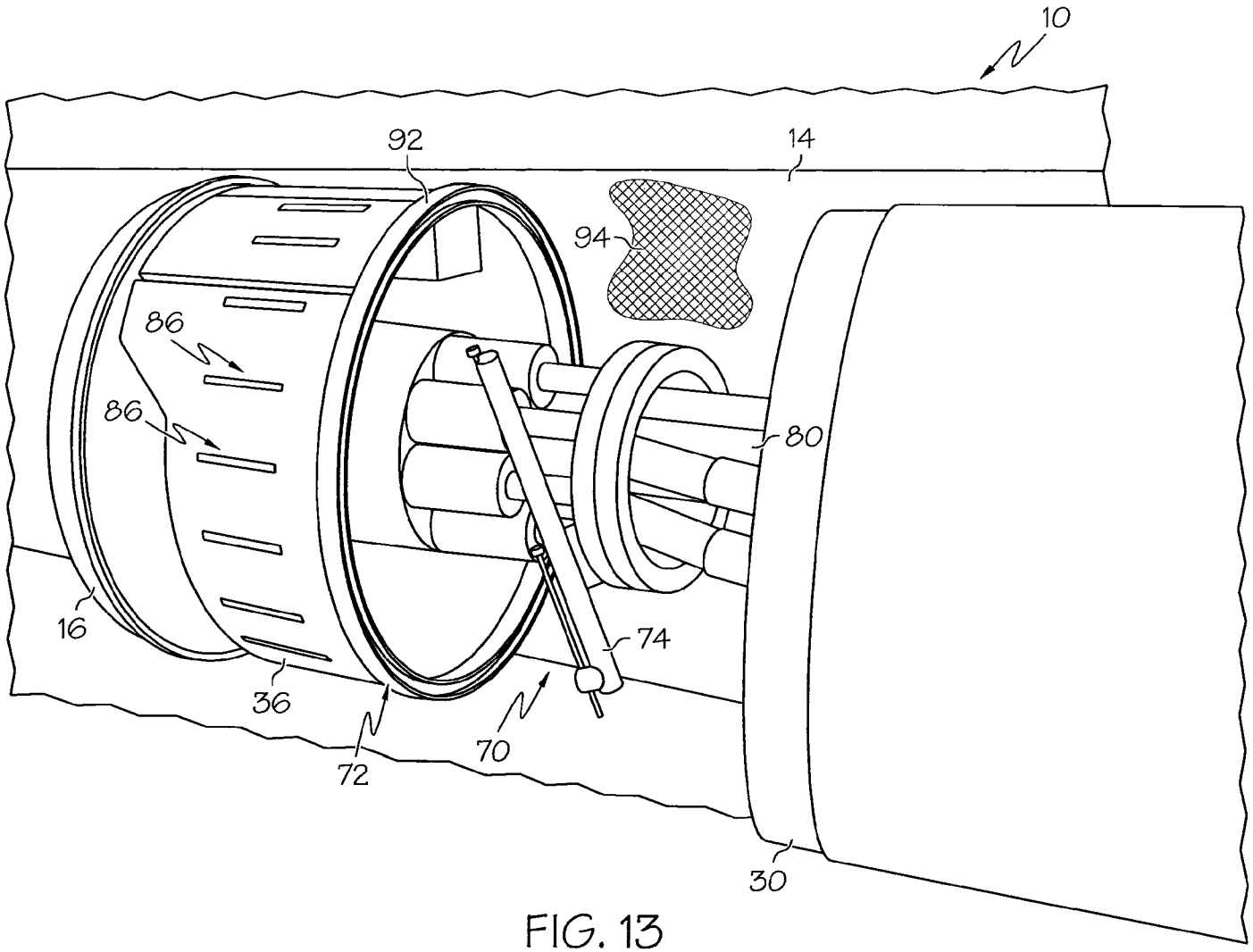
FIG. 13 is a side view of the example tunnel boring machine of FIG. 9 with the arm assembly installing the ground support device of an arch and shotcrete.

As shown in FIG. 13, the ground conditioning work zone 70 can include structure for placing a ring beam 92 along the surface of the tunnel wall 14 to secure the ground. One example of a ring beam 92 is a circular steel I-beam that is erected to support the tunnel 12 where the rock is not self-supporting. The arm assembly 74 can be configured to install a series of ring beams 92. A ring beam erector 132 (shown in FIG. 19) can also be provided in the ground support zone 70 for installation of ring beams 92 and other ground support devices. Each ring beam 92 can be comprised of a number of different pieces, such as six, which form a ring beam 92 about the entire periphery of the tunnel. The ring beam 92 can be configured to provide some allowance to yield under pressure. For example, six different pieces of the ring beam 92 can each comprise a 59° arc but when assembled together and expanded by a radial jack, the different pieces can form a complete 360° ring. In one example, the ring beam 92 can be expanded in two places, such as at 10 o'clock and 2 o'clock, so that only a portion of the arch of the ring beam 92 needs to be lifted. The ring beam 92 can also be configured to contract by an amount, after the ring beam 92 has been expanded outwards. The ring beam 92 thus can yield under pressure to some degree without collapsing. The ring beam 92 can be selectively installed when encountering weak ground conditions or squeezing ground conditions.

The ground conditioning work zone 70 can also include structure for dispersing shotcrete 94 on the tunnel wall 14 to secure the ground. The shotcrete 94 can be dispersed from the arm assembly 74 such that it can be applied in a wide range of angles relative to a longitudinal axis of the TBM 10. For example, the shotcrete 94 could be applied in a 270° angle along the tunnel wall 14 when access to the tunnel wall 14 is provided by retracting the first shield 30. Wet shotcrete 94 can be pumped directly from supply cars to a wet shotcrete 94 mixer/hopper for pumping to the ground conditioning work zone 70. The shotcrete 94 can be applied by a machine with a feeding hopper, a dosage pump, and a spraying nozzle. A spraying lance can also be provided.

Figure 14:
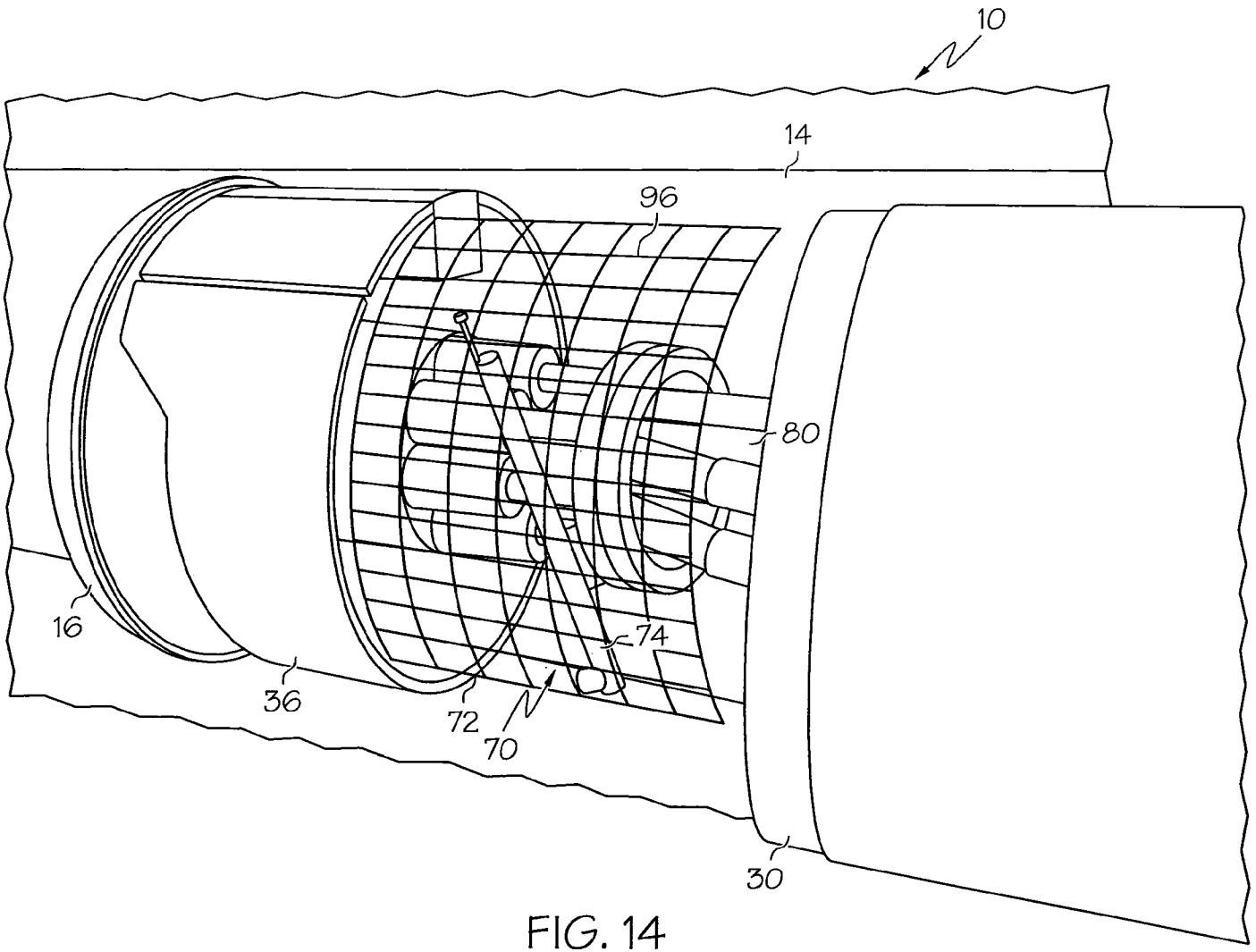
FIG. 14 is a side view of the example tunnel boring machine of FIG. 9 with the arm assembly installing the ground support device of a mesh structure.

As shown in FIG. 14, the ground conditioning work zone 70 can include structure for placing a mesh structure 96 along the surface of the tunnel wall 14 to secure the ground. The mesh structure 96 can be a steel wire formed in a grid pattern. The mesh structure 96 can also be held in place by a rock bolt.

In one example, the arm assembly 74 can include two probing drills 82 and two drills for providing rock bolts 90. The arm assembly 74 or other structures can also perform various ground support operations, as discussed or as known. Combinations of different ground support operations can also be used. Each probing drill 82 can be mounted on its own circular gear allowing independent operation. The probing drills 82 can have a rollover feature which allows them to be used for roof bolting, probing, and pre-excavation hole 84 drilling.

The TBM 10 can also include at least one roof drill. The roof drills can be mounted on custom fixtures designed to have a wide range of motion that will allow them to drill holes in nearly the entire tunnel 12. The holes can be approximately 30 degrees from a pure radial line. Each roof drill can also be moved completely independently of the other drill. The roof drills can be used simultaneously with TBM 10 boring, probing drills, or any of the other example structures.

Figure 15:
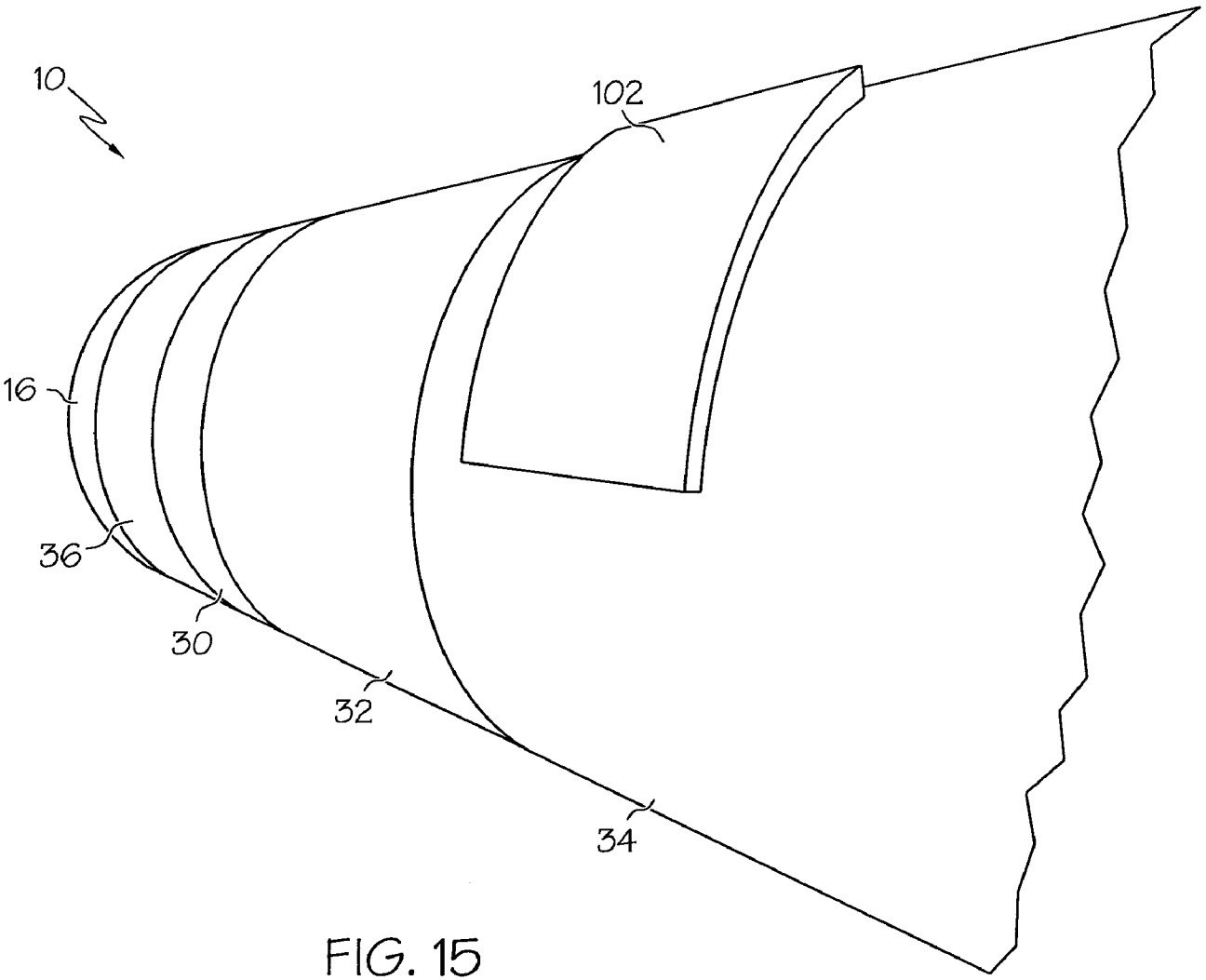
FIG. 15 is a rear perspective view of the example tunnel boring machine of FIG. 1 showing a gripper shoe in an extended position.

As shown in FIG. 8, a gripper shoe 102 is shown that can be located within the third shield 34. The gripper shoe 102 can be a convex steel structure attached to both sides of a TBM 10 that extend and anchor against the side of the tunnel walls 14 to support the TBM 10 while boring. The gripper shoe 102 can provide a reaction force for both the torque and propulsion thrust of the TBM 10 as the TBM 10 moves forward in the tunnel. A hinged gripper arrangement provides an effective three point gripping action. The gripper shoe 102 is configured to move between an undeployed position, shown in FIG. 8, and an extended position, shown in FIG. 15. The gripper shoe 102 is moved to the undeployed position at the end of a boring stroke. While the gripper shoe 102 is in the undeployed position, the third shield 34 and the gripper shoe 102 are then pulled forward to begin the next boring stroke. In the extended position, the gripper shoe 102 is in contact with the tunnel wall 14 and applies force on the tunnel wall 14. In one example, the gripper shoe 102 is configured and sized to provide a maximum pressure 3.0 MPa against the tunnel wall 14. The gripper shoe 102 can move independently of the main beam 80 yet it can also selectively secure itself by a gripper hydraulic mechanism 108, such as a torque cylinder shown in FIG. 16, to the main beam 80 to react the full force of boring with the disc cutters.

Figure 16:
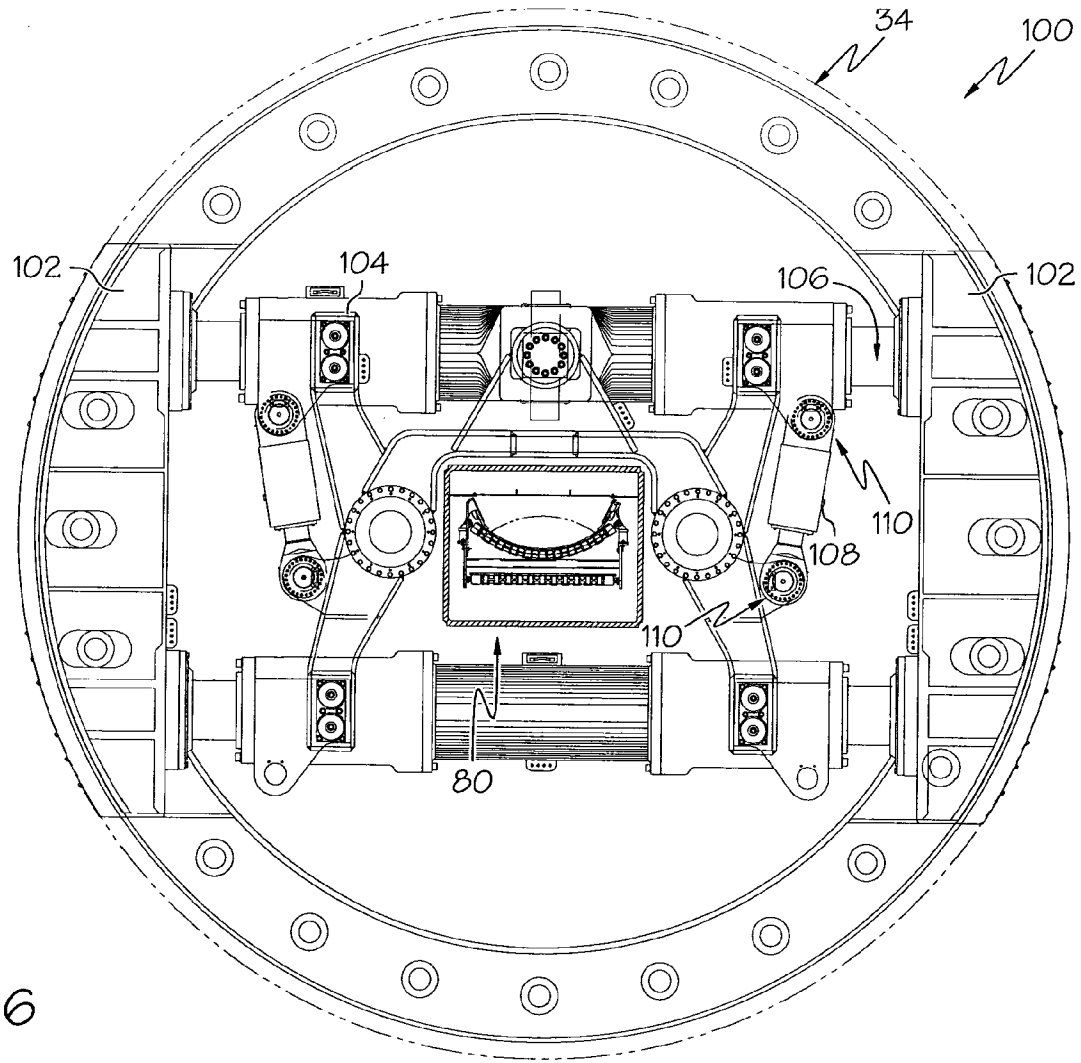
FIG. 16 is a front view of a gripper assembly that includes the gripper shoe of FIG. 15.

In FIG. 16, a front view of a gripper assembly 100 that includes the gripper shoe 102 is shown. The gripper assembly 100 can be of the floating type. The gripper assembly 100 can include a number of components to properly mount the gripper assembly 100 on the main beam 80. The gripper assembly 100 can further include at least a gripper carrier 104 that is configured to house the gripper shoe 102. The gripper carrier 104 can also receive a gripper cylinder 106, or other device, for providing a force to push the gripper shoe 102 against the tunnel wall 14. The gripper cylinder 106 is configured to move within the gripper carrier 104. The at least one gripper shoe 102 can also be mounted on hinge pins. The gripper shoe 102 holds the main beam 80 and directs the cutter head 16 through the floating gripper system. The floating gripper assembly can facilitate optimum advance rates even in the hardest of rock. The gripper assembly 100 can also further include at least one gripper hydraulic mechanism 108, such as a torque cylinder. The gripper hydraulic mechanism 108 can provide vertical steering adjustments for the TBM 10.

Figure 17:
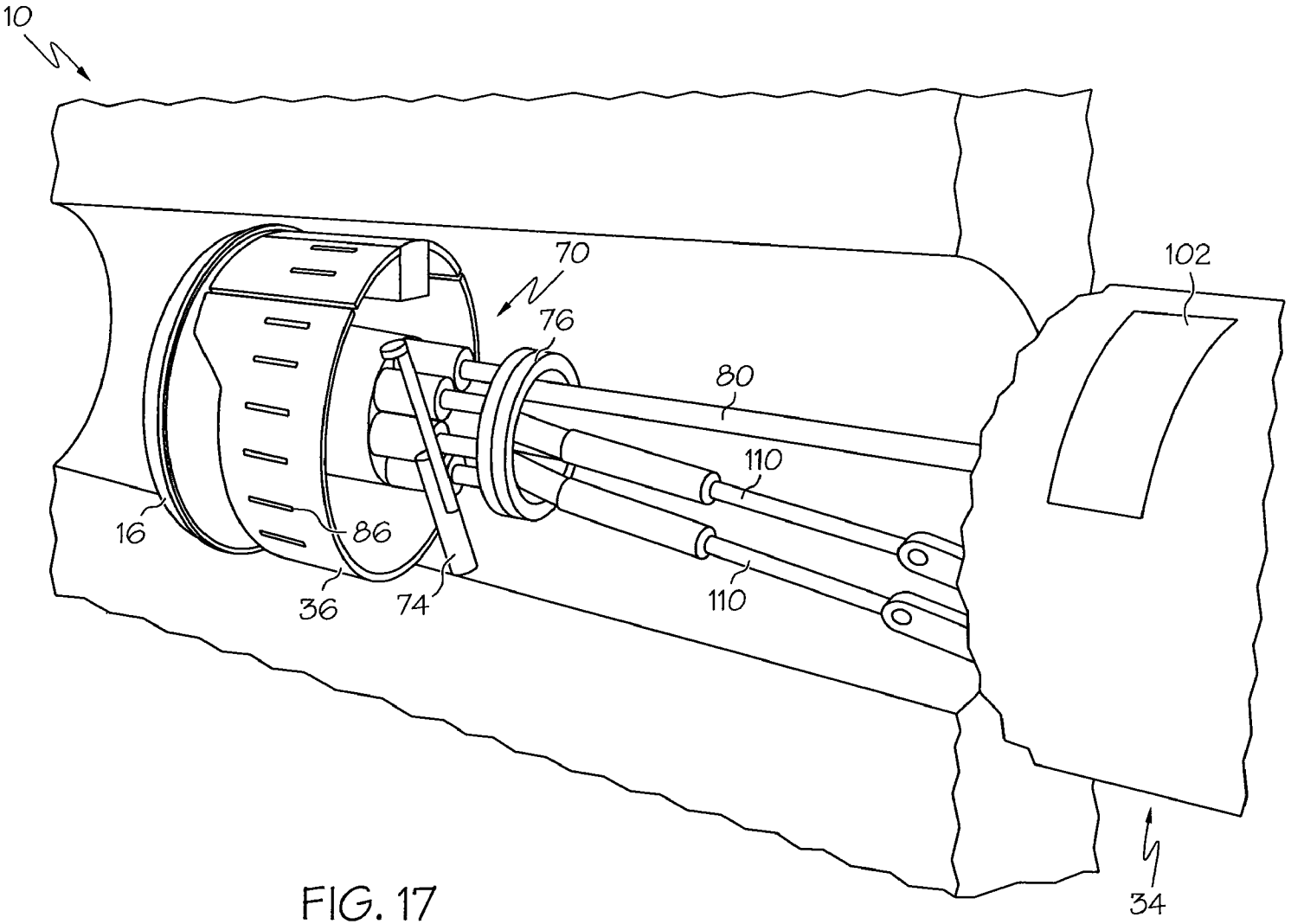
FIG. 17 is a side view of the example tunnel boring machine of FIG. 1, with the first shield and the second shield broken away to show the interior of the tunnel boring machine and to show a first propulsion mechanism.

As shown in FIG. 17, a sectional view of the TBM 10 is shown where the second shield 32 is broken away to show a plurality of first propulsion mechanisms 110. At least one first propulsion mechanism 110, such as a propel cylinder, can be provided and it is appreciated that various amount of first propulsion mechanisms 110 can be provided. In one example, there can be four first propulsion mechanisms 110 with a 400 mm bore. The at least one first propulsion mechanism includes one end in contact with the main beam 80 and another end in contact with one of the third shield 34 and the gripper shoe 102. In the example shown, the second end is in contact with the third shield 34 which includes the gripper shoe 102. The at least one first propulsion mechanism 110 is configured to push against the third shield 34 as it is secured into a lateral position by the gripper shoe 102 when the gripper shoe 102 is in the deployed position of FIG. 15. The first propulsion mechanism 110 moves the cutter head 16, the first shield 30, and the second shield 32 forward while the third shield 34 and the gripper shoe 102 remain stationary. The at least one first propulsion mechanism 110 provides the main propulsion system for the TBM 10.

Due to the presence of the main beam 80, the first propulsion mechanisms 110 can be situated about the center of the TBM 10 while being attached to the main beam 80. Each first propulsion mechanism 110 can be individually operated for steering control. Alternatively, groups of first propulsion mechanisms 110 can be controlled by sector to provide a reliable steering system. A circuit can be provided for controlling the gripper shoe 102 pressure to be increasingly proportional relative to the pressure of the first propulsion mechanism 110. Thus, in one example, steering for the TBM 10 can be provided by application of varying forces on each of the first propulsion mechanisms or through the application of varying forces by the gripper assembly 100, such as the gripper hydraulic mechanism 108, on the main beam 80.

Figure 18:
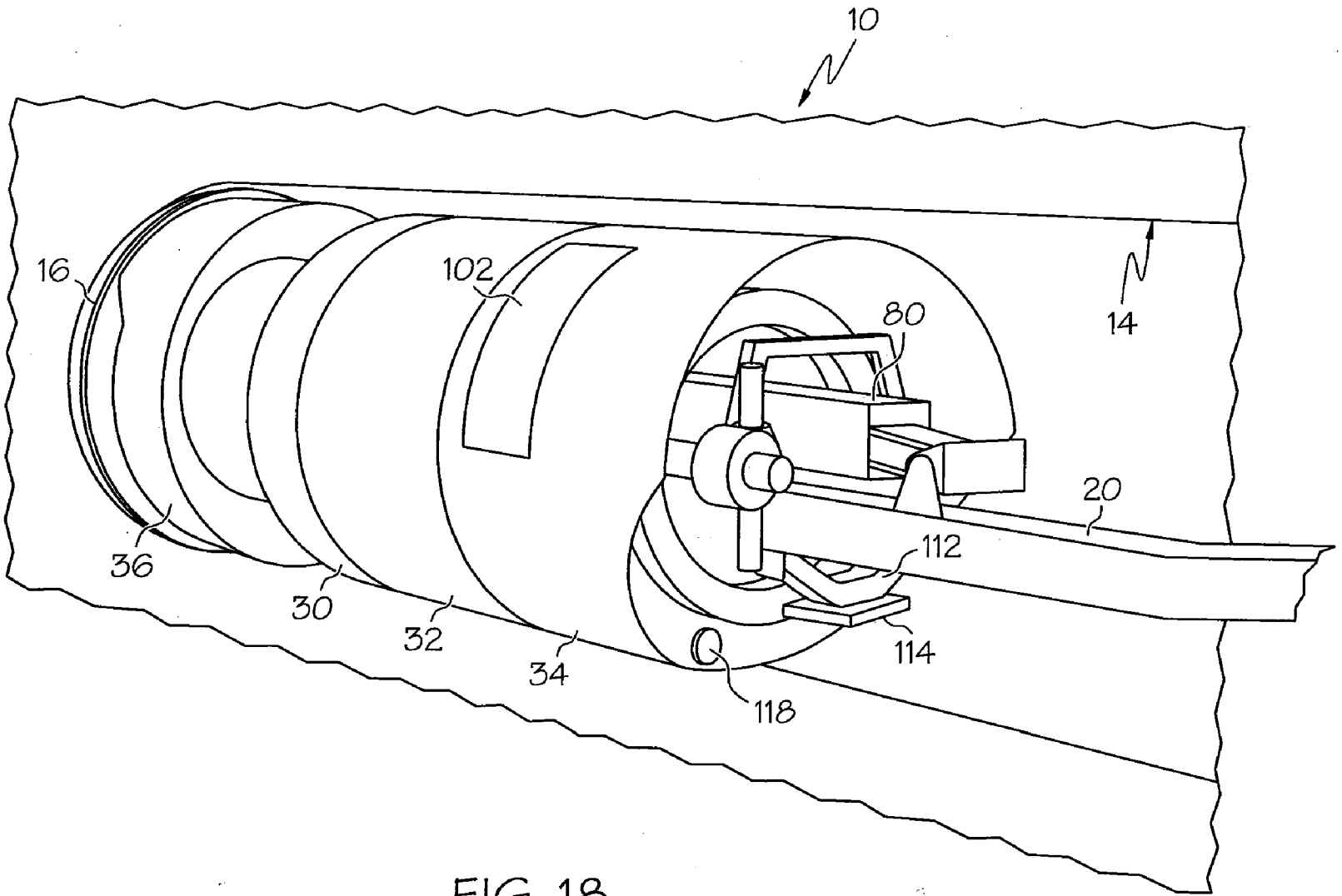
FIG. 18 is a rear perspective view of the example tunnel boring machine of FIG. 1 showing a conveyor and a segment erector arm.

As shown in FIG. 18, a rear view of the TBM 10 is shown. A conveyor 20 is shown leading out from the TBM 10. The main beam 80 can be configured to support at least a portion of the conveyor 20. The conveyor 20 is configured to transport material cut by the cutter head 16 out of the tunnel 12.

At the rear portion of the third shield 34, a segment erector arm 112 can be provided that is configured to pickup and install or place a segment to line the tunnel wall 14. The segment erector arm 112 can include a mechanical or a vacuum pickup system 114 for carrying a segment 116. The segments 116 can be installed either simultaneously while the TBM 10 is boring the tunnel 12 or can be installed in a sequential operation.

Figure 19:
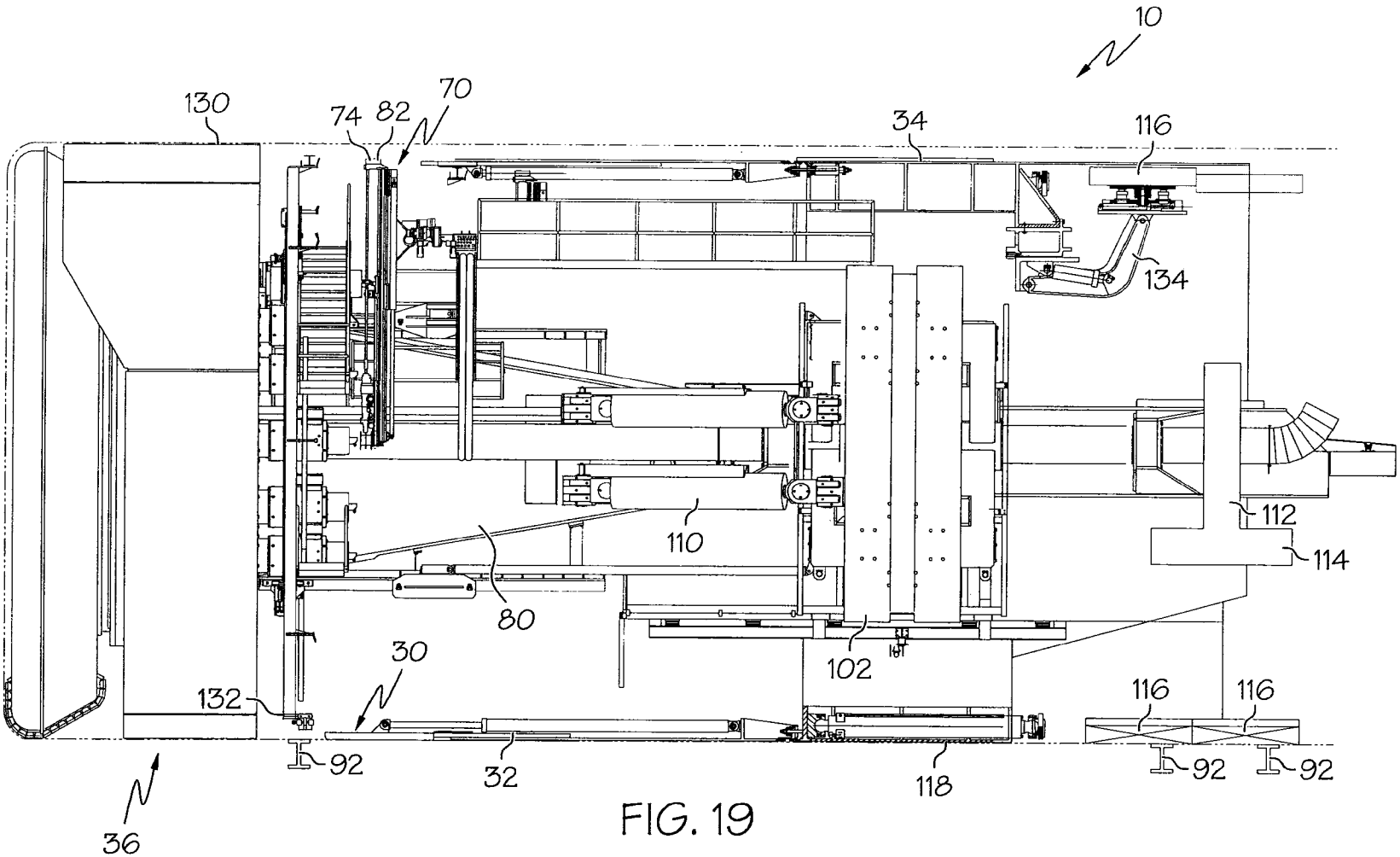
FIG. 19 is a side view of the example tunnel boring machine of FIG. 1.

Thus, in one example of the TBM 10 shown in FIG. 19, the TBM 10 can include a cutter head 16 with a cutting mechanism 18, a first shield 30, a second shield 32, a third shield 34, a main beam 80, a gripper shoe 102, a ground conditioning work zone 70, an arm assembly 74, at least one first propulsion mechanism 110, at least one second propulsion mechanism 118, and a segment erector arm 112 for installing segments to line a tunnel wall 14 by the use of a pickup system 114. Ground support devices 72 can also be provided by the arm assembly 74, such as by providing a bolt 90, a ring beam 92, a mesh structure 96 or the application of shotcrete 94. A roof support assembly 50 can also be provided within the first shield 30, on a cutter head support assembly 36, or located between the first shield and the cutter head support assembly 36. A variety of conveyors 20 and other structures can be provided for disposing of the rock and muck produced by boring out the tunnel. Additional backup systems can be provided to further support and enhance the operations of the TBM.

As shown in FIG. 19, a side view of the TBM 10 with many of the structures already described being shown. The TBM 10 can further include an additional front shield 130, such as in front of the cutter head support assembly 36 or as structure surrounding the cutter head support assembly 36. The side view also shows that a separate ring beam erector 132 can be installed in addition to a probe drill 82 on an arm assembly 74. The ring beam erector 132 is configured to install the various ring beams 92 in the tunnel wall. The segment erector arm 112 is shown at the rear of the TBM 10. It is appreciated that alternatively, a second style segment erector arm 134 can alternatively be installed. The alternative segment erector arm 134 is of a shorter configuration and can be installed when it is desired to have a shorter overall length for the TBM 10. There can also be multiple segment erector arms 134 installed on one TBM 10 due to the smaller size. FIG. 19 also shows one example of how the segments 116 can be installed within the ring beams 92, as shown on the lower right side of the drawing.

Figure 20:
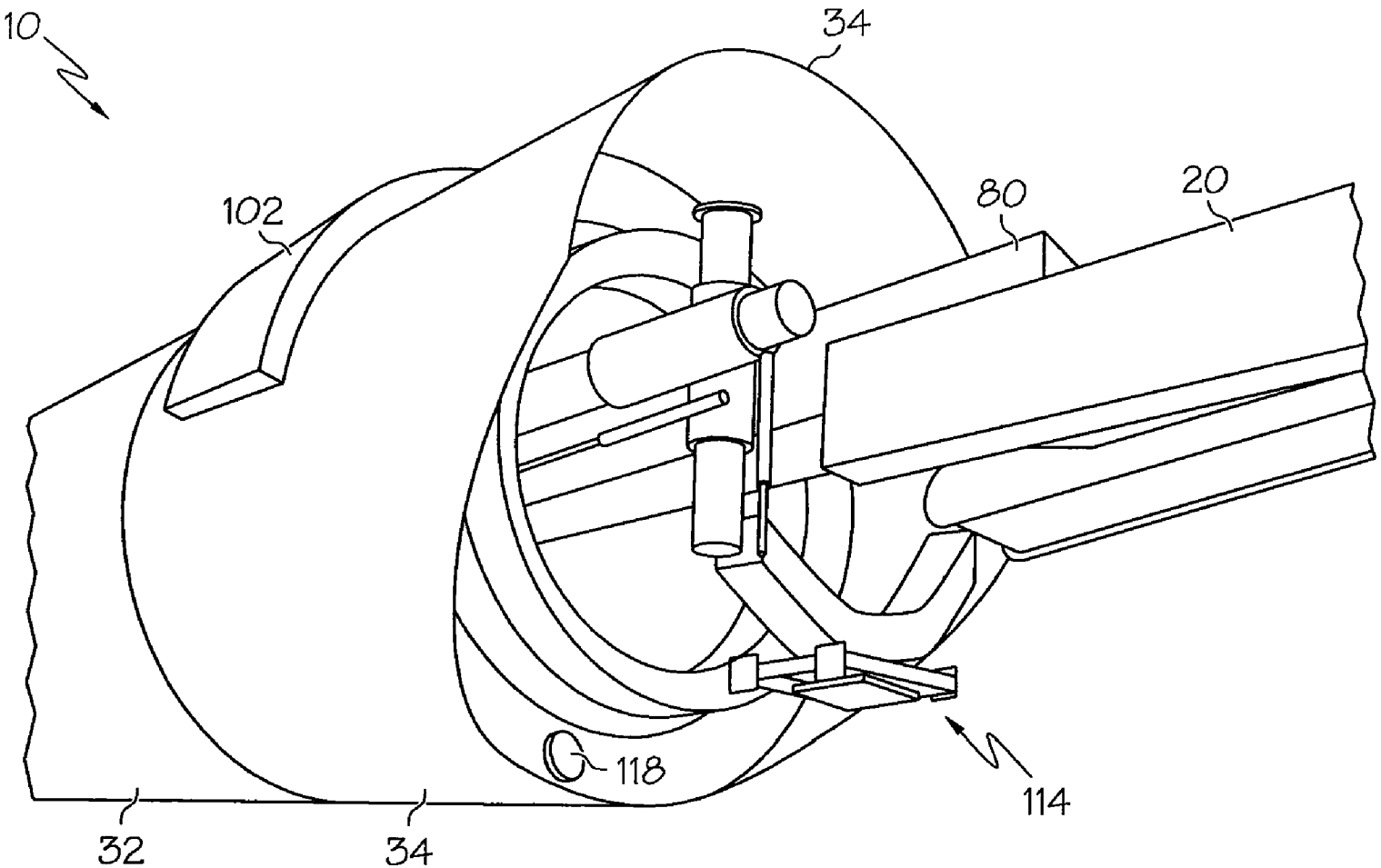
FIG. 20 is a bottom rear perspective view of the example tunnel boring machine of FIG. 18 showing the segment erector arm.

As shown in FIG. 20, the segment erector arm 112 is movable along the main beam 80 through the tunnel 12. The segment erector arm 112 can also rotate about the main beam 80 to provide a variety of orientations. The segment erector arm 112 is configured to place a plurality of segments 116 to line the tunnel wall 14 as the cutter head 16 is moving forward. The conveyor 20 can connect the TBM 10 to a back-up system and provide support for hoists that load segments 116 that will be used to line the tunnel 12. A set of hoists can be used to unload the segments 116 from the segment cars or hoists for transfer to the segment erector arm 112 that is shown in FIG. 18.

The segments 116 can be placed under the cover of the third shield 34. It is appreciated that the third shield 34 can be comprised of more than one shielded portion, such as one shield for protecting the gripper shoe 102 and another shield for protecting the segments 116 as they are installed. The segment erector arm 112 can be in a location to minimize exposure to the tunnel wall 14 before the segment 116 is fully installed. The third shield 34 can have an open bottom with an angular cutout to allow segments 116 to be placed as close as possible to the tunnel wall 14 itself. When pre-cast segments 116 are used to line the tunnel 12, there can be an annular gap between the outside of the segment 116 and the tunnel wall 14, as partially shown in FIG. 22. Contributing to the size of this gap is the thickness of the third shield 34, allowance for primary rock support, plus over-cut beyond the shield diameter for steering purposes. The annular gap must be filled as soon as possible for support purposes, to reduce any potential for ground subsidence, to stabilize and ensure the circularity of the lining, and to provide a watertight barrier for the tunnel 12. Typically, backfilling can be performed by injection of gravel and grout to install the segments 116. The backfilling can be applied through the segment 116 itself. However, it is also possible to provide ground conditioning pipes within the shield for 100% ground conditioning backfilling operations. Alternatively, pea gravel and grout can be injected to any gap located between the segments and the tunnel wall 14 to fully secure the segments 116 relative to the tunnel wall 14.

In addition, the third shield 34 can be equipped with wire brush tail seals to prevent the ingress of grout or pea gravel into the area where the segments 116 are being installed and into the interior of the shielded regions. When a full 360 degree third shield 34 is specified, two rows of wire brush seals can be used. The wire brush tail seals are grease impregnated via grease lines integral to the third shield 34. An automated greasing system can be provided. Second propulsion mechanisms 118, as will be described with regards to FIG. 23, have adequate stroke to push the TBM 10 forward sufficiently to totally expose the wire brush tail seals for service or replacement. One example of the third shield 34 that can be provided is an outwardly projecting spring steel plate, which acts as a seal to prevent backfilling from flowing forward and encasing the shield. The axial travel of the segment erector arm 112 is sufficient to place segments 116 over the tail seals following maintenance.

Figure 21:
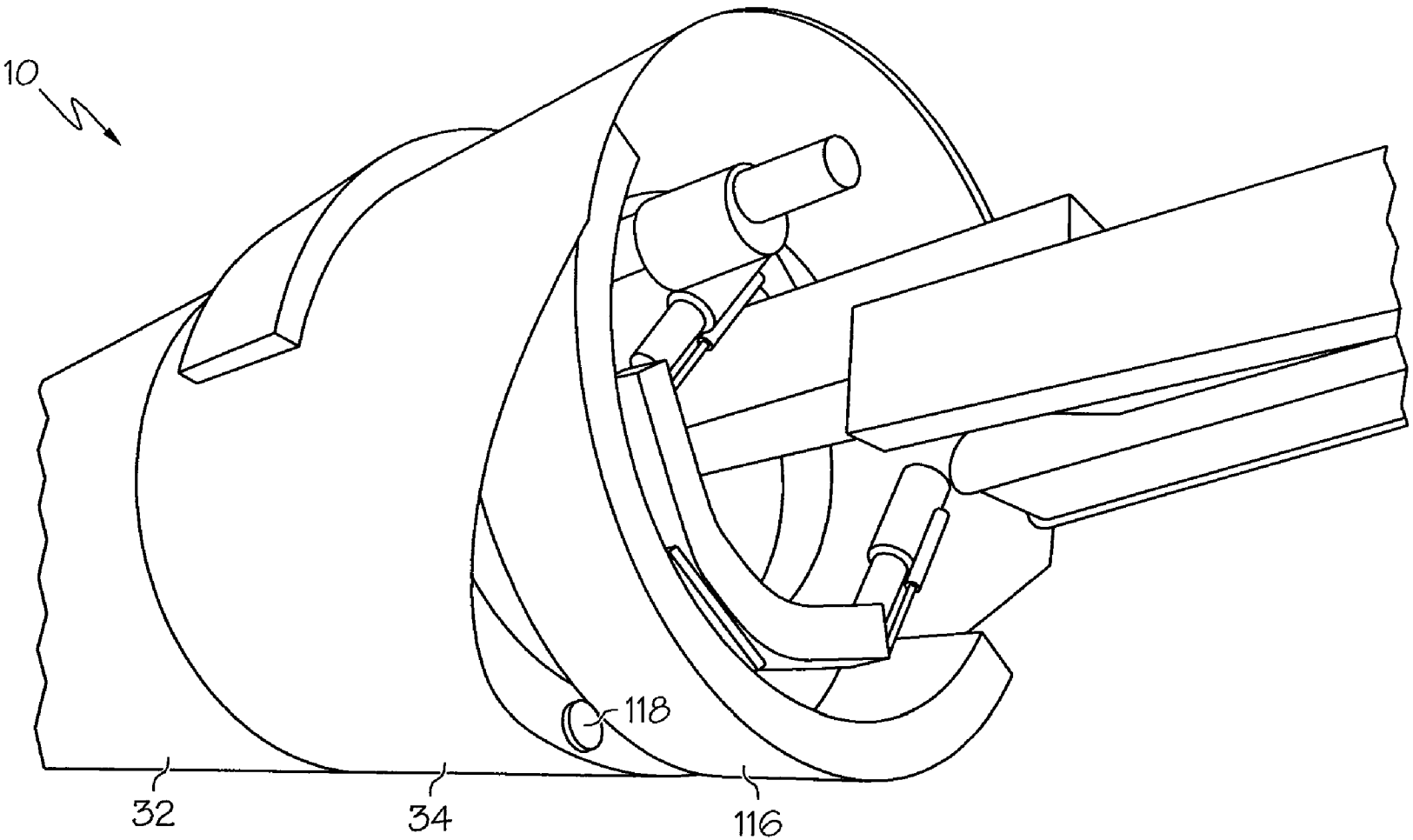
FIG. 21 is a bottom rear perspective view of the example tunnel boring machine of FIG. 20 showing the segment erector arm installing a segment.

The segments 116 can be placed in multiple pieces, such as a top and a bottom, or can be fabricated in one piece for installation in the tunnel 12. As shown in FIG. 21, the segment 116 can be placed on the tunnel wall 14. The segment erector arm 112 allows for positioning and installing the segments 116 which can be made of concrete. Control can be provided by either an interference proof radio control station or a pendant station. Both can be supplied with priority safety interlocks. Variable speed is provided for rotation of the segment erector arm 112. Six degrees of freedom of motion for the segment erector arm 112 allow an accurate placement of segments. Hydraulic cylinders allow the segments 116 to be moved through all planes for quick and positive positioning. It is appreciated that the segments 116 can be installed on top of the ring beam 92 or other ground support devices 72 that are already installed.

Figure 22:
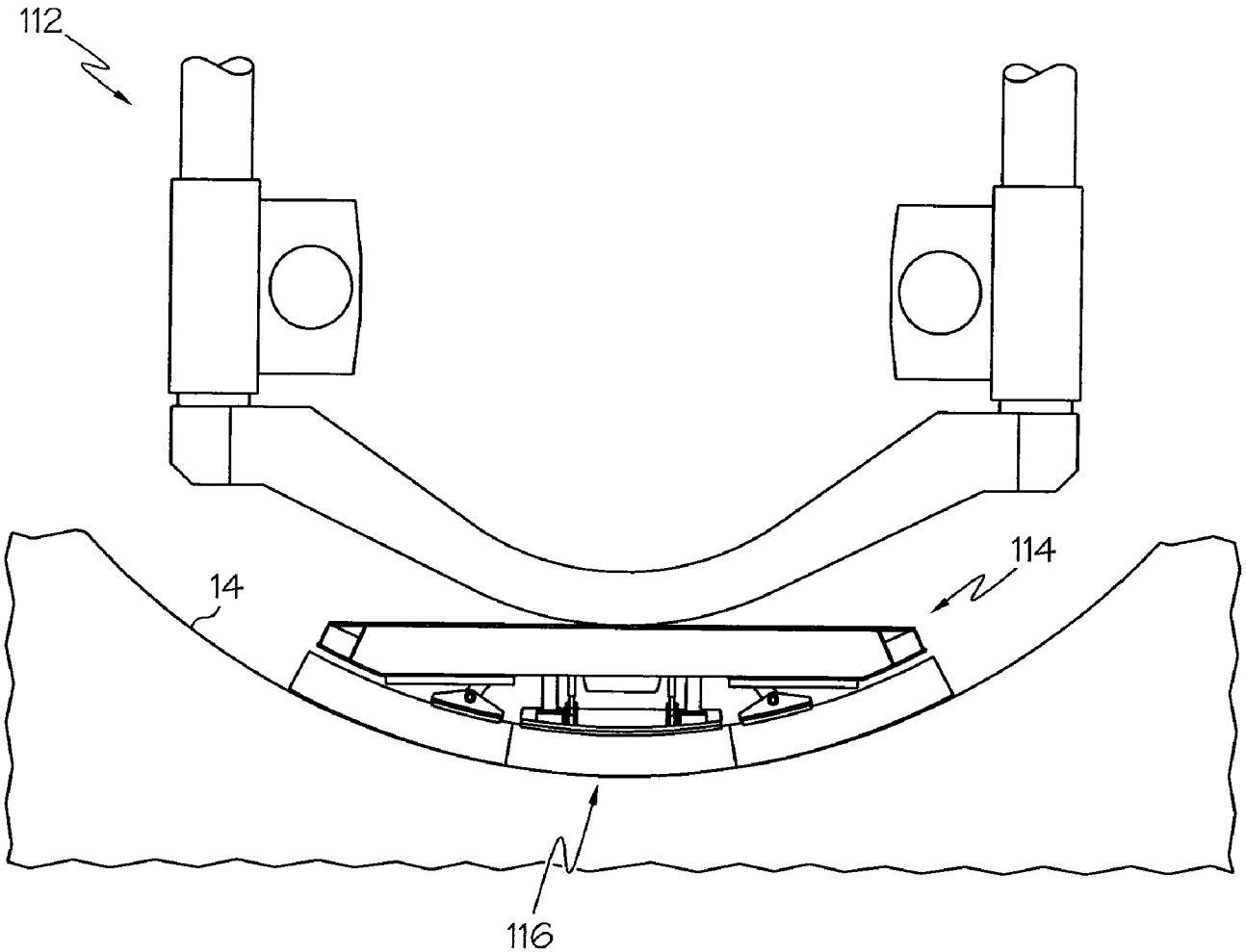
FIG. 22 is a front view of the segment erector arm of FIG. 18 in a first position.

As shown in FIG. 22, a rear view of the segment erector arm 112 as it installs a segment 116 is shown. The segment erector arm 112 can include a pickup system 114 for carrying a segment 116. The pickup system 114 is configured to lower the segment 116 onto the tunnel wall 14. Alternatively, the segment 116 can be lowered on to a ground support device 72, such as a ring beam 92 if a ring beam 92 was installed on the tunnel wall 14. A portion of the segment erector arm 112 can move radially, such as between a first position and a second position where the segment is in contact with the tunnel wall, to install the lining segments 116 to support the tunnel 12. It is appreciated that the geometry of the segment 116 shown here is by example only and that other angles and geometries can be used.

Figure 23:
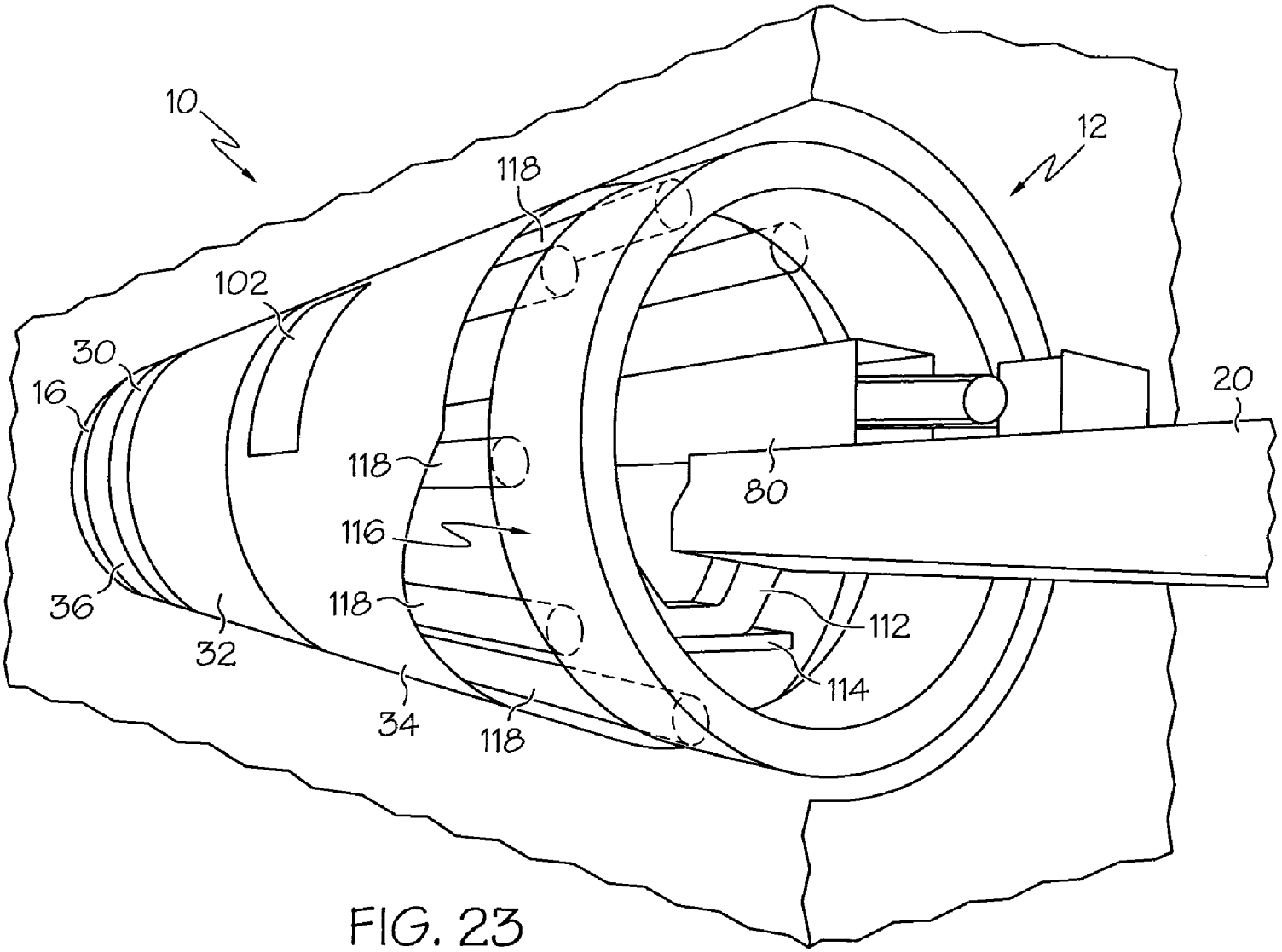
FIG. 23 is a rear perspective view of the example tunnel boring machine of FIG. 21 showing the second propulsion mechanisms.
Figure 24:
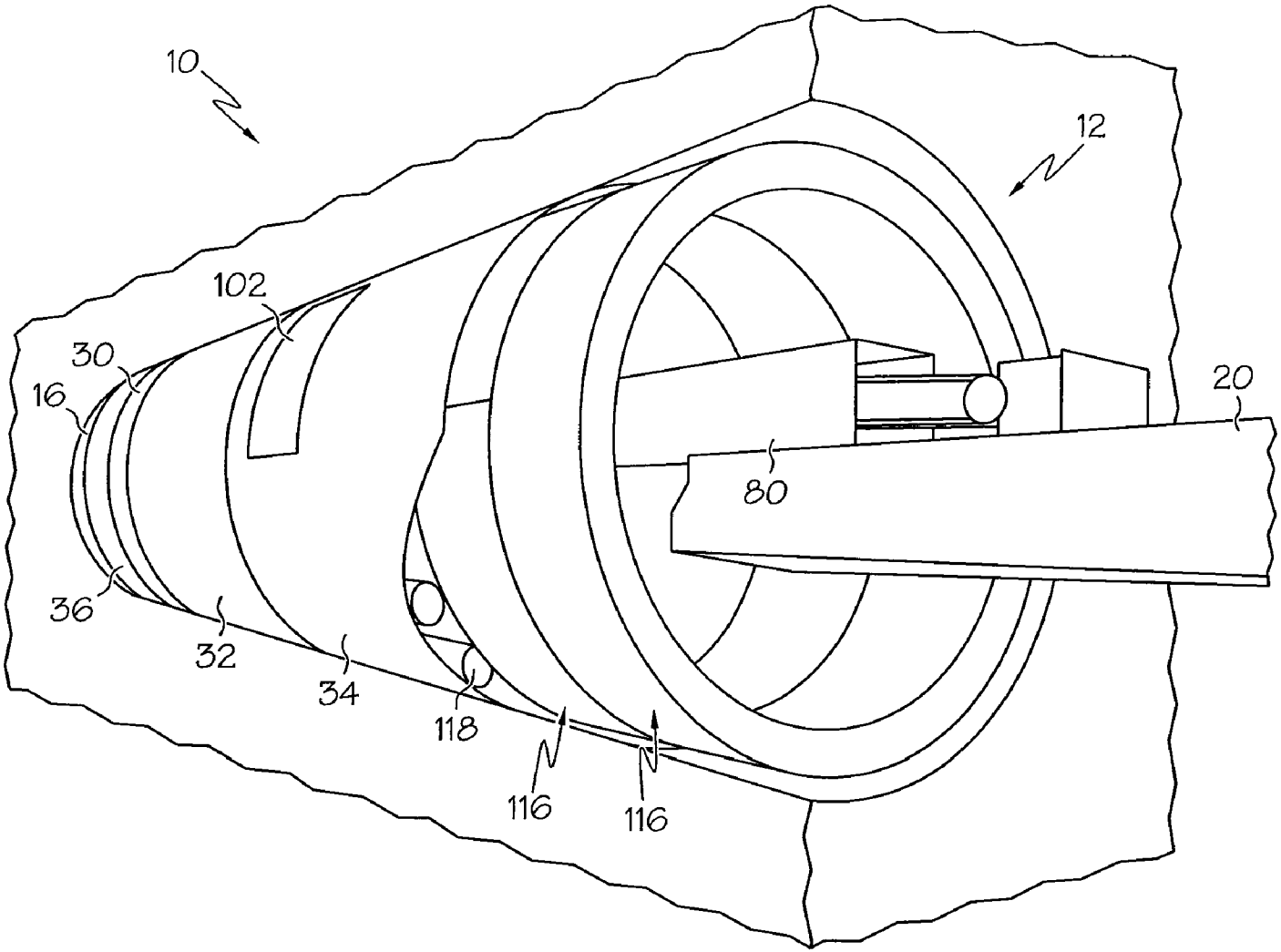
FIG. 24 is a rear perspective view of the example tunnel boring machine of FIG. 23 showing the second propulsion mechanisms retracted within the third shield.

As shown in FIG. 23, at least one second propulsion mechanism 118 can be provided. The at least one second propulsion mechanism 118, such as a thrust cylinder, can include a first end in contact with the third shield 34 and a second end that is movable to push off of the most recently installed segment 116. In one example, there can be eleven auxiliary second propulsion mechanisms 118 having a bore of 330 mm. Once each segment 116 is in proper position, the appropriate second propulsion mechanisms 118 are extended sufficiently to establish the required sealing force with the segment 116 to which it is mated. The at least one second propulsion mechanism 118 is configured to push off with the second end pushing against the most recent segment 116 of the tunnel wall 14 to advance the cutter head 16, the first shield 30, the second shield 32, the third shield 34, and the gripper shoe 102, such as when in single shield mode. After the cutter head 16, the first shield 30, the second shield 32, the third shield 34, and the gripper shoe 102 are moved forward, the at least one second propulsion mechanism 118 is retracted within at least the third shield 34, as shown in FIG. 24.

The at least one second propulsion mechanism 118 provides an auxiliary propulsion system for the TBM 10 to advance into the tunnel 12 when the ground conditions are poor. An example boring stroke by the second propulsion mechanism 118 is approximately 1.5-2.0 meters. The size of the stroke can correspond to a width of one of the plurality of segments 116 that are installed on the tunnel wall 14. If the gripper shoe 102 is unable to find solid support in the ground, the TBM 10 will be unable to propel itself. However, the second propulsion mechanisms 118 can be used to still move the TBM 10 forward even when the gripper shoe 102 cannot be used. Each second propulsion mechanism 118 can be individually operated and equipped with a polymer thrust pad, such as a neoprene thrust pad. Alternatively, groups of second propulsion mechanisms 118 can be controlled by sector to provide a reliable steering system.

Each of the second propulsion mechanisms 118 and the first propulsion mechanisms 110 can be designed with a safety factor of two based on the yield of the cylinder barrel at maximum working pressure. All cylinder rods can be hardened and chrome plated. The system includes warning and fault indicators for level and temperature. Indicators give visual warnings on the operators console and automatically shut down TBM 10 thrust and cutter head 16 rotation at pre-set limits.

A boring stroke can be performed using either the first propulsion mechanisms 110 or the second propulsion mechanisms 118. For the first propulsion mechanisms 110, the gripper shoe 102 is first placed in an extended position. The first propulsion mechanisms 110 are then extended to push forward the cutter head 16, the first shield 30, and the second shield 32 forward while the third shield 34 and the gripper shoe 102 remain stationary. The first propulsion mechanisms 110 are then retracted to push the gripper shoe 102 and/or the third shield 34 forward. With regards to the second propulsion mechanisms, the second propulsion mechanisms 118 can push off of the latest segment 116 to be installed in the tunnel 12 to advance the cutter head 16, the first shield 30, the second shield 32, the third shield 34, and the gripper shoe 102. The second propulsion mechanisms 118 are then retracted within at least the third shield 34, and a new segment 116 is installed. The second propulsion mechanisms 118 thus move the TBM 10 by the length of the segment.

The arrangement of the main beam 80 and the first propulsion mechanisms 110, shown in FIG. 9 and in FIG. 19, can provide a clear periphery area behind the cutter head 16, as opposed to having cutting head drives, first propulsion mechanisms 110, and/or second propulsion mechanisms 118 located directly behind the cutter head 16. This arrangement allows various structures to be placed in the ground conditioning work zone 70 and allows full access to the tunnel wall 14 in the ground conditioning work zone 70.

The main beam 80 can act as a lever for steering, using the cutter head support assembly 36 as a fulcrum for vertical steering, and the side supports as a fulcrum for horizontal steering. Thus, a steering system can be provided where the main beam 80 is configured to be directed for any horizontal or vertical direction. The main beam 80 can also be directed in any horizontal direction by extension of either one of the gripper cylinders 106 where more force is applied on to one of the gripper cylinders 106. One of the gripper hydraulic mechanisms 108 can be activated to move the main beam 80 up or down. Trunion mounting of the gripper shoe can allow for continuous steering during the boring stroke, with only momentary reduction of thrust to protect cutters during steering movement. In another example, the main beam 80 can be directed in any direction since each of the second propulsion mechanisms 118 can be individually operated to steer the main beam 80 at an angle. The design of the main beam 80 and the gripper shoe 102, in combination with the various first propulsion mechanisms 110 and second propulsion mechanisms 118 of FIG. 17 and FIG. 20, can provide for precise control of steering for the TBM no matter which type of propulsion system is being used.

For horizontal steering, the barrel of the gripper shoe is moved sideways over the continuous pressurized gripper rods and pistons. As the barrel is trunion mounted to the gripper carrier way, the gripper carrier way or main beam is also moved sideways and horizontal steering is effected. For vertical steering, gripper hydraulic mechanisms 108 can be mounted, as shown in FIG. 16. When the gripper hydraulic mechanisms 108 are extended, the main beam 80 can rise relative to the gripper shoe and the TBM 10 will steer down. Conversely, when the torque cylinders are retracted, the main beam 80 can be lowered relative to the gripper shoe and the TBM 10 will steer up.

In the example TBM 10, the first propulsion mechanisms 110 are best used when the gripper shoe 102 is able to have a solid contact with the tunnel wall 14. The example TBM 10 can properly strengthen the rock of the tunnel wall 14 before the gripper shoe 102 comes into contact with the tunnel wall 14. The strengthened tunnel wall 14 increases the likelihood of the TBM 10 continuing to use the first propulsion mechanisms 110 for movement of the TBM 10. This way, a plurality of segments 116 can still be installed at the same time that the TBM 10 continues to move forward.

The auxiliary propulsion provided by the second propulsion mechanisms 118 can be used when the rock is too weak to utilize the gripper shoe 102. By placing the second propulsion mechanisms 118 and the segment erector arm 112 to the rear of the gripper shoe 102, this creates additional space near the cutter head 16 of the TBM 10. The additional space can be used for the roof support assembly 50 and for probing, detection, and other ground support devices 72. Additional space is also created in the ground conditioning work zone 70 by placing the first propulsion mechanisms 110 about the main beam 80 of the TBM 10.

The ground conditioning work zone 70 is located in a position that allows additional support for the tunnel 12 to be installed while still providing a shielded structure between the location of the operators of the TBM 10 and where the ground conditioning work zone 70 is located. However, in prior art designs, the tunnel lining segments 116 in the prior art would be attempted to be installed before the tunnel 12 had been given any additional supports, or before the tunnel 12 had been treated with ground supporting features. The example TBM 10 here can improve the ground structure before the segments 116 are installed to ensure that the rock stress forces have come into a balance before the final lining is placed by the segment erector arm 112. Moreover, treating the ground before the position of the gripper shoe 102 increases the chance that the TBM 10 can propel itself from the gripper shoe 102. By propelling from the gripper shoe 102, this allows the segment erector arm 112 to continue its operation. Thus, improvements in time for boring a tunnel 12 and lining the tunnel walls 14 can occur in comparison to the prior art due to the presence of the ground conditioning work zone 70 and the increased use of propulsion by the first propulsion mechanisms 110. The TBM 10 can also increase the amount of times that it is propelled by the first propulsion mechanisms 110, as opposed to being propelled by the second propulsion mechanisms 118.

A backup system can be provided that is designed to interface with the concrete segments 116, as described with regards to FIG. 21, and the muck haulage by train or conveyor 20. The backup system can include a series of rolling platforms with a single rail track for supply trains and space for mounting various equipment and sub-systems to support the TBM 10 and other works. The backup system can include different amounts of conveyors 20. A towing system can be provided that includes tow cylinders to connect the aft end of the TBM 10 conveyor 20 to the main beam 80. The backup system can be pulled forward as required with the tow cylinders. The towing system also can allow the TBM 10 to be backed away from the rock face without moving the backup system. Various specifications can be used for the backup system. For example, in a tunnel 12 diameter of 6.2 meters with a segment Length/Boring Stroke of 1.5 m, a number of example specifications can be provided. For example, the towing system stroke can be 1.80 m; a track gauge can have a dimension of 900 mm; a backup conveyor 20 can have a dimension of a 610 mm troughed belt; the length of the TBM 10 and the backup can be approximately 150 m; the rail laying area length can be 12.5 meters; the number of platforms and rolling decks can be 17; a segment 116 lifting hoist can be provided with an unloading hoist capacity of 5.0 tons; a fresh water system can be provided; a tunnel 12 dewatering system can be provided; a dewatering tank can be provided with a volume of 2.0 cubic meters; a dewatering pipe can be provided from the forward backup area to tank and from the tank to dewatering hose reel; a dewatering hose reel can be provided; submersible pumps for tunnel 12 invert; submersible pumps can be provided for placement in the dewater tank; a dust scrubber with a turbo filter can be provided; a fresh air duct diameter; an emergency generator with approximately a 75 kW power capacity; a Segment Backfill Pea Gravel; a Grout Pump; a Mixer for the grout; a Grout Holding tank with agitator; a closed circuit television: 6 cameras total (TBM 10 and Backup); and a Shotcrete machine with a hopper, a dosage pump, and a spraying nozzle. A fire suppression system can also be provided. The fire suppression system can include six (6) LTA-101-30 systems, which will be triggered automatically in the case of a fire on the hydraulic pack, or can be triggered manually.

Older, single speed TBMs employed clutches in order to minimize current inrush during motor starting, as the motors were started under no load with the clutches disengaged. The clutches also protected any gear reducers from impact loading caused by the rotational inertia of the motors when the cutter head 16 is suddenly stalled. It is appreciated that the cutter head 16 can be rotated in either a clockwise or counterclockwise direction. However, a TBM 10, with cutter head 16 motors powered by a variable frequency drive (VFD), typically uses a torque limiting coupler between the motor and gear reducer to protect the gear reducers. Because the VFD systems have zero current inrush on startup, it is not necessary to have a clutch to minimize current inrush. Torque limiters are typically less expensive than clutches; hence nearly all VFD driven TBMs are fitted with torque limiting couplings.

However, clutches can offer an advantage for the TBM 10 when excavating mixed ground conditions, as the TBM 10 is designed to encounter all types of ground conditions. When the clutches are engaged with the motors rotating at high speed, a very high dynamic torque is applied to the cutter head 16. This is very useful for freeing a stuck cutter head 16. This mode of operation is intended to be used only when other methods for freeing a stuck head are unsuccessful. Thus, providing a clutch can help provide a way to prevent the TBM 10 from becoming stuck in the ground and can be used in emergency conditions. The VFD torque limiting coupling can be replaced by a hydraulically activated clutch. This allows all motors to be activated under no load brought to the desired rotational speed, and then the clutches engaged to deliver a high rotation impact load to the cutter head 16. In case of a cutter head 16 stall by a dramatic geological event, the gearboxes are protected against the high inertia of the electric motors by the clutch. The clutches can also be used to impart the high rotational inertia to the cutter head 16, which can provide a relatively high breakout torque to free a stuck cutter head 16.

High quality industrial grade hydraulic components can be part of a hydraulic system for the example TBM 10. The hydraulic system can include the gripper shoe 102, the propulsion system (e.g. the first propulsion mechanisms 110 and the second propulsion mechanisms 118), the segment erector arm 112 and the drive system for the conveyor 20. Double-ended electric motors can drive pumps at each end of the motors. High pressure/low volume and low pressure/high volume pumps can be incorporated. Fixed and variable volume pumps are used depending on circuit requirements. Hydraulic logic components may be cartridge and/or sub-plate mounted. Hydraulic oil can be filtered when leaving the reservoir, before delivery to the various cylinders and hydraulic motors. Low pressure return oil can be filtered upon return to the tank. Both supply and return filters can be fitted in tandem with valves to allow maintenance of filters while the machine is operating. Near-zero pressure return lines (case drains) are plumbed directly to reservoir with no restrictions. The hydraulic system can also be provided with an example power requirement of 150 kW. The hydraulic system and lubrication system can have electric motors that can be operated between 400-480 V at 50 Hz. Example operating specifications include approximately a system operating pressure of 275 bar, a maximum system pressure of 345 bar, an emergency auxiliary thrust pressure of 485 bar, and a power requirement of 225 kW.

The TBM 10 transformers, electrical cabinets and hydraulic system can be mounted on the back-up system. The transformers can be provided to convert the example primary voltage of approximately 15,000 V at 50 Hz to 690 V, 3 phases, at 50 Hz. These two transformers are dedicated to supply power exclusively to the VFD controlled main drive motors of the cutter head 16. The cutter head 16 drive can be 8×315 kW with variable frequency. The VFD motors can be water cooled and have a dedicated, closed loop cooling system to maintain the cleanliness of the cooling system. The cutter head 16 can also be water cooled to allow rapid ingress for cutter inspection and replacement. The cutter head 16 power can be 2520 kW. The cutter head 16 speed can be approximately 0 to 11.0 rpm or in another example, 0-4.94 rpm. The cutter head 16 torque can be at 5.5 rpm with 4362 kNm and at 11.4 rpm with 2181 kNm and in another example at 2.47 rpm with 12,759 kNm and at 4.94 rpm with 6,380 kNm. The cutters can be 11" to 20" or in another example 17" to 19". The diameter of the TBM 10 can be of any dimension, such as greater than 4.00 meters, though in one example the dimension is approximately between 6.20 and 6.70 meters. The cutter head 16 can have a relatively heavy structure and can also have a design that will accept some flexing without cracking. The cutter head 16 can also be profiled to reduce wear by minimizing the rock-steel contact and providing smooth surfaces where there is rock-steel contact. The TBM 10 can be equipped with between a 483 mm (19 inch) and a 508 mm (20 inch) diameter back loading disc cutters capable of boring hard and soft rock formations. 19 inch to 20 inch cutters typically require less replacement than 17 inch cutters. The cutters can operate in hard massive rock or fractured unstable rock.

A programmable logic controller (PLC) can be provided for the control system of the TBM 10. A PLC is a flexible electronic control device that replaces hardwired relay logic. The PLC is designed to be modular, expandable, and easily maintainable. The PLC can be part of a detection system for monitoring the operation of the tunnel boring machine 10 and can be located in the operator station 120. The PLC can aid machine control by monitoring all major functions of the TBM 10 and warning the operator with clear messages when unsafe limits are being approached. The operator can have a "touch screen" monitor and a control panel. The operator's monitor can include controls and/or indicators for the lights, digital readouts and analog meters for real-time TBM 10 operation data, warnings, faults and automatic shutdown.

For example, one piece of data that can be monitored is the advance rate in comparison to the material removal rate, to reduce the risk of excavating the tunnel 12 in a manner that would increase the risk of a cave-in. An operator station 120 can be provided in FIG. 1 to the rear of the third shield 34 and the segment erector arm 112. The operators of the TBM 10 can be located in the operator station 120 under the tunnel wall 14 that already has a segment 116 installed. Alternatively, the operator station 120 can be located in other portions of the TBM 10, in the tunnel 12, or in other locations outside of the tunnel 12. The operator's station 120 can be fully enclosed, sound attenuated, and air-conditioned. The operator's station includes hydraulic and electric controls and indicating devices, which allow for ease of machine operation by a single operator. All hydraulic and electrical controls necessary for machine operation are located at a control console within the operator's station. The various operating parameters and faults are displayed by color monitors. In addition, the operator has a view of several working areas via closed circuit television monitors. It is appreciated that the operation station can be located in many different locations. In this example, the operator station 120 can be located underneath a conveyor 20 or to the rear of the conveyor 20. The conveyor 20 can have varying widths, though in one example, the width of the conveyor 20 can be 1370 mm. When certain pre-set limits are reached (such as temperature, pressure, flow, or physical position of a component), the PLC will safely shut down the TBM 10 systems affected. In addition, the PLC provides considerable troubleshooting information to assist mechanics and electricians in minimizing downtime for repairs.

The two primary components of the control system are the PLC and the operators display unit. The PLC is also fitted with various analog and digital input and output modules. Input to the PLC is directly from the TBM 10 operator's controls, primarily a man-machine interface unit, and from the many analog and digital transducers mounted on the equipment. Output from the PLC is to the TBM 10 operator station 120 in the form of lights, meters, graphs, etc. which are displayed on the operator's console. Output from the PLC is also sent to various control devices (i.e. hydraulic valves and electrical switches) via the system programming logic. In addition to the standard on/off detectors of the pressure switch, temperature switch, level detectors and limit switch type, a number of analog detectors are mounted on the mechanical equipment to provide proportional signals for display and control purposes. The system monitors and controls (via program logic or on instruction from the operator) hydraulic, lubrication and electrical devices such as: pressures, flow rates, travel-limit switches, linear transducers for position of mechanical devices, etc. The display unit in the operator's station displays most information in numeric or graphical displays.

The example TBM 10 can also include an automatic data acquisition and display system in combination with the PLC for data logging and instantaneously monitoring and recording all activities. The data can be transmitted to control stations on the surface and to the TBM 10 operation station, shown in FIG. 1, to facilitate informed advance technique decisions between the project management and the operating crew. Data can be collected, stored and displayed at many locations. The data can include:

Date and time stamp
Tunnel 12 station (location)
Rate of penetration
Start/Stop Time (i.e. propel pressure greater than X)
Boring Stroke position
Penetration Rate
Thrust pressure
Gripper pressure
Position of main thrust stroke (%)
Position of auxiliary thrust stroke (%)
Cutter head 16 rotational speed (% or rpm)
Cutter head 16 power (torque, kW) being used (%)
Cutter head 16 thrust being used (%)
Deviation from theoretical tunnel 12 line and grade and absolute position of TBM 10 and height above sea level
TBM 10 roll and pitch
Lubricant temperature
Hydraulic Oil Temperature
Incoming cooling water temperature
VFD cooling water temperature Using the automated control functions available to the operator, it is possible to have the TBM 10 operate at a continuous cutter head 16 power level (torque at a given cutter head 16 speed), in spite of varying ground conditions, by continuously automatically adjusting the propel force (pressure) via the PLC. By keeping the main motor power to an even, high level, the load on the cutter head 16 will remain at a high but safe level, providing maximum cutting efficiency and higher rate of penetration.

It is also appreciated that the TBM 10 can have an automatic guidance system where an operator can override the guidance system if need be. A machine guidance system can provide the TBM 10 operator with a single-screen, real-time graphical presentation of the TBM 10 position and orientation. Such a presentation permits the TBM 10 operator to easily apply the appropriate steering to precisely maintain accurate line and grade. An accurate two-axis electronic inclinometer can be used to measure the pitch and roll of the TBM 10.

A number of example operating specifications can also be provided. The following specifications are examples only and other specifications can also be used. Due to the possible presence of squeezing ground, it is necessary to provide a relatively high start-up torque and a relatively high operating torque to obtain a proper rotation of the cutter head 16 under the squeezing conditions. It is also appreciated that adequate power for excavating the rock is derived by establishing the load on the cutters' friction factor and maximum RPM. The load on the cutter should be conservatively established at 35 tonnes per cutter. The resistance factor should be conservatively established at 0.08. The maximum RPM is that which is possible before the material stays in the cutter head 16 due to the centrifugal force (i.e., does not drop out of the cutter head 16 muck bucket scoops onto the conveyor 20). It is important not to specify excess power as the excess power (larger or more motors) takes up essential working space in the key rock support area behind the cutter head support assembly 36. This impedes the rapid installation of ground support devices 72 in the ground conditioning work zone 70.

In one example, the propulsion system can have a cutter head 16 thrust between 12,751 (41×311 kN) and 21,400 kN, a maximum Main Machine Thrust between 17,000 kN and 25,700 kN, a maximum Auxiliary Thrust 30,500 kN, an emergency Auxiliary Thrust 42,700 kN. It is appreciated that these values are only examples and depend on the specific TBM size and diameter that is selected. The variable speed control for the cutter head 16 can use flux vector control technology. The cutter head drive motors can include six to ten 330 kW, watercooled, Pole induction motors. Each motor can include an embedded thermal detector for PLC fault processing and a display on the control station. An electrical system for the TBM 10 can also be provided. A power requirement of 660 v-690 v can be required for the motor circuit 660 v-690 v, with a 3-Phase operation, operating at 50 Hz. A control system and a lighting system can have a power requirement of 110-120 V, operating at 50 Hz. Two transformers can also be provided. The primary voltage for the TBM 10 can be 11,000V and a secondary voltage requirement can be between 380V and 660V.

The conveyor 20 can have a range of specifications as well. For example, the belt width can be 750 mm wide and the conveyor 20 can have the capacity to transport between 400-1388 $m^3$ of rock per hour. The belt speed for the conveyor 20 can be between 0 to 3.5 m/second. The total weight of the TBM 10 can be approximately between 475 and 1000 tonnes depending on the size of the tunnel 12 that needs to be bored. Two dedicated transformers can be supplied, providing approximately 2500 kVA each, to convert the primary voltage to approximately 690 VAC, at 3 phases, 50 Hz for all non-cutter head 16 drive electrical loads. One other transformer can be provided to approximately provide 1000 kVA for the auxiliary motors. The auxiliary motors can be 400 VAC, at 50 Hz. The power necessary for controlling the system can be 24 VDC or 110 VAC.

Lighting fixtures can be provided and mounted to give a good visibility and adequate illumination around the machine and specific lighting for primary work areas. One-third of all light fixtures can be battery back-up type, emergency lights with 1 hour battery powered illumination in emergency. Lighting fixtures can be provided and mounted to give a good visibility by operation and servicing. The minimum lighting intensity, depending on the particular area, is:

work areas: ≧200 lux
highly lit areas: ≧300 lux
pedestrian access areas: ≧120 lux
Other areas: ≧100 lux The power of lighting appliances shall be limited to a maximum of 2×40 W fluorescent except for high lighting areas, where floodlighting shall be provided. The general electrical circuits and lighting can demand between 110-220 VAC, 50 Hz.

A backup electrical system can also be provided. In one example, the backup electrical system can provide power for the controls, the backup system, the lighting system, tools, as well as an outlet for an electric arc welder.

The emergency lighting service can be activated after shutdown when methane gas is detected by a gas detection system. The gas detection system can include a gas detector that will sound an alarm at the lower preset levels and higher preset levels. In the case of methane gas, an automatic shut down of the TBM 10 at the higher preset level is provided. The gas detection system can include three sets sensors: one on back of the cutter head support assembly 36, one in the vicinity of the operator station 120, and one can be in the dust scrubber exhaust discharge area. The TBM 10 shut down is accomplished by tripping the main breakers at the electrical control cabinets. Only the methane detector will remain powered. The high voltage transformers, which contain hermetically sealed switchgear, remain energized. The explosion-proof battery backup lighting will remain on for approximately one hour.

It is appreciated that additional structures can be added to an example TBM 10, such as the TBM 10 shown in FIG. 19. Dust shield systems, a clutch for producing a higher torque for the cutting mechanism 18, a programming logic controller, and a control panel can also be provided in further examples. It is appreciated that various data relating to the operation of the TBM 10 and to the tunnel 12 being bores can be transmitted to a plurality of locations. Other example TBMs 10 can be provided using any of the other structures described herein, in combination or by adding each structure individually. Any specific operating specifications throughout this specification are only presented for example purposes. The TBM 10 can operate in a single shield mode, a double shield mode, and can provide a retractable shield for a ground conditioning work zone 70 to have access to a tunnel wall for probing and installation of ground support devices 72.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A tunnel boring machine comprising:

a cutter head that includes at least one cutting mechanism that is configured to bore out a tunnel having a tunnel wall;

a first shield located behind the cutter head about a perimeter of the cutter head and extending in a longitudinal direction away from the cutter head;

a ground conditioning work zone located within the first shield;

a second shield located behind the first shield;

a third shield located behind the second shield;

wherein the first shield, the second shield, and the third shield provide protection for an interior of the tunnel boring machine;

a main beam located within the interior of the tunnel boring machine;

a gripper assembly located within the third shield configured to move a gripper shoe between an undeployed position and an extended position that is in contact with and applies force on the tunnel wall;

wherein the ground conditioning work zone includes at least one arm assembly for probing the terrain in advance of the cutter head wherein the at least one arm assembly is supported by the main beam within the ground conditioning work zone;

wherein the first shield is configured to be retracted relative to the second shield to provide access to the interior of the tunnel for the at least one arm assembly to apply at least one ground support device;

a segment erector arm movable along the main beam and located behind the third shield;

wherein the segment erector arm is configured to install a plurality of segments to line the tunnel wall;

at least one first propulsion mechanism that includes one end in contact with the main beam and another end in contact with one of the third shield and the gripper assembly;

wherein the at least one first propulsion mechanism is configured to push against the third shield as it is secured in position by the gripper shoe when the gripper shoe is in a deployed position, wherein the at least one first propulsion mechanism moves the cutter head, the first shield, and the second shield forward while the third shield and the gripper assembly remain stationary.

2. The tunnel boring machine according to claim 1, wherein the at least one arm assembly includes at least one probing device configured to probe and pre-treat rock on an angled direction of 360° of the perimeter of the tunnel in advance of the front of the tunnel boring machine.

3. The tunnel boring machine according to claim 1, wherein the at least one arm assembly includes two probing drills and two drills for providing rock bolts.

4. The tunnel boring machine according to claim 1, further comprising a cutter head support assembly located between the cutter head and the first shield; wherein the cutter head support assembly includes a roof support assembly configured to apply force to a portion of the tunnel wall to provide support for the tunnel wall.

5. The tunnel boring machine according to claim 4, wherein the roof support assembly is hydraulically expandable on a portion of the tunnel wall.

6. The tunnel boring machine according to claim 1, further comprising a cutter head support located between the cutter head and the first shield; wherein the cutter head support includes a plurality of apertures that are configured to receive the at least one probing device for drilling at least one hole for probing the terrain in front of the cutter head and wherein the plurality of apertures also can receive at least one ground conditioning agent.

7. The tunnel boring machine according to claim 1 further comprising a steering system where the main beam is configured to be directed for any horizontal or vertical direction through application of varying forces by the gripper assembly on the main beam.

8. The tunnel boring machine according to claim 1, further comprising a guidance system that includes a real-time graphical presentation of a position and orientation of the tunnel boring machine.

9. The tunnel boring machine according to claim 1, wherein the tunnel boring machine is configured for use in at least one of the following rock types: agglomerate, tuff, granite, quartzite, basalt, diorite gneiss, homblende gneiss, quartz schist, pure quartz, dolerite, hard sandstone, hard dolomite and limestone, siltstone, mudstone, shale, and slate.

10. The tunnel boring machine according to claim 1, further comprising a programmable logic controller configured to monitor the operation of the tunnel boring machine and produce warnings for an operator.

11. The tunnel boring machine according to claim 1, further comprising:

at least one muck bucket on the perimeter of the cutter head;

wherein the at least one muck bucket transports any material produced by boring out the tunnel and transports the material on to a conveyor through the interior of the first shield, the second shield, and the third shield to a rear portion of the tunnel.

12. The tunnel boring machine according to claim 1, wherein the second shield is attached to the third shield with an articulated joint.

13. The tunnel boring machine according to claim 1, wherein the cutter head provides an overbore capability by providing at least one cutting mechanism that is configured to change positions to expand a boring diameter of the cutter head.

14. A tunnel boring machine comprising:

a cutter head that includes at least one cutting mechanism that is configured to bore out a tunnel having a tunnel wall;

a conveyor configured to transport material cut by the cutter head;

a main beam configured to support the conveyor;

a first shield located behind the cutter head about a perimeter of the cutter head and extending in a longitudinal direction away from the cutter head;

a ground conditioning work zone located within the first shield;

a second shield located behind the first shield;

a third shield located behind the second shield;

wherein the first shield, the second shield, and the third shield provide protection for an interior of the tunnel boring machine;

a gripper assembly located within the third shield configured to move a gripper shoe between an undeployed position and an extended position that is in contact with the tunnel wall wherein the gripper shoe applies force on the tunnel wall to secure the position of the third shield;

an arm assembly within the ground conditioning work zone wherein the arm assembly is supported by the main beam;

wherein the arm assembly includes at least one probing drill for drilling at least one hole to probe the terrain that has not yet been bored in front of the cutter head and in front of the first shield;

wherein the first shield is configured to be retracted relative to the second shield to provide access for the arm assembly to the interior of the tunnel wall;

wherein the arm assembly is further configured to apply at least one ground support device when the first shield is retracted relative to the second shield at a location behind the cutter head and in advance of the second shield wherein the at least one ground support device includes at least one of the following:

at least one ground conditioning agent that is configured to fill at least one of the holes upon a detection of unstable ground, water, or weak rocks;

a bolt that is configured to secure the ground;

a ring beam that is configured to secure the ground;

a mesh structure that is configured to secure the ground; and an amount of shotcrete that is configured to be dispersed on the tunnel wall to secure the ground;

a segment erector arm movable along the main beam and located behind the third shield and configured to install a plurality of segments to line the tunnel wall as the cutter head is moving forward;

at least one first propulsion mechanism that includes one end in contact with the main beam and another end in contact with one of the third shield and the gripper assembly; wherein the at least one first propulsion mechanism is configured to push against the third shield as it is secured in position by the gripper shoe when the gripper shoe is in a deployed position, wherein the at least one first propulsion mechanism moves the cutter head, the first shield, and the second shield forward while the third shield and the gripper assembly remain stationary; and at least one second propulsion mechanism that includes a first end in contact with the third shield and a second end being movable; wherein the at least one second propulsion mechanism is configured to push off with the second end pushing against the most recently installed segment of the tunnel wall to advance the cutter head, the first shield, the second shield, the third shield, and the gripper assembly.

15. The tunnel boring machine according to claim 14, wherein the arm assembly probes and pre-treats rock on an angled direction of 360° of the tunnel perimeter in advance of the front of the tunnel boring machine.

16. The tunnel boring machine according to claim 14, wherein the arm assembly includes two probing drills and two drills for providing rock bolts.

17. The tunnel boring machine according to claim 14, wherein the at least one hole is at a 7° angle relative to a longitudinal axis of the main beam.

18. The tunnel boring machine according to claim 14, wherein the at least one second propulsion mechanism is activated to propel the tunnel boring machine when the ground conditions are poor.

19. The tunnel boring machine according to claim 14, further comprising a cutter head support assembly located between the cutter head and the first shield; wherein the cutter head support assembly includes a roof support assembly configured to apply force to a portion of the tunnel wall to provide support for the tunnel wall.

20. The tunnel boring machine according to claim 19, wherein the roof support assembly is hydraulically expandable on a portion of the tunnel wall.

21. The tunnel boring machine according to claim 14, further comprising a cutter head support located between the cutter head and the first shield; wherein the cutter head support includes a plurality of apertures that are configured to receive the arm assembly for drilling the at least one hole for probing the terrain in front of the cutter head and wherein the plurality of apertures also can receive the at least one ground conditioning agent.

22. The tunnel boring machine according to claim 14, wherein the shotcrete can be applied in a 270° range along the tunnel wall when the first shield is retracted.

23. The tunnel boring machine according to claim 14, further comprising a steering system that includes individually controlling the forces provided by each second propulsion mechanism.

24. The tunnel boring machine according to claim 14, further comprising a steering system where the main beam is configured to be directed for any horizontal or vertical direction through application of varying forces by the gripper assembly on the main beam.

25. The tunnel boring machine according to claim 14, further comprising a guidance system that includes a real-time graphical presentation of a position and orientation of the tunnel boring machine.

26. The tunnel boring machine according to claim 14, wherein the tunnel boring machine is configured for use in at least one of the following rock types: agglomerate, tuff, granite, quartzite, basalt, diorite gneiss, hornblende gneiss, quartz schist, pure quartz, dolerite, hard sandstone, hard dolomite and limestone, siltstone, mudstone, shale, and slate.

27. The tunnel boring machine according to claim 14, wherein the at least one second propulsion mechanism provides a stroke of between 1.5 meters and 2.0 meters corresponding to a width of one of the plurality of segments being installed on the tunnel wall.

28. The tunnel boring machine according to claim 14, further comprising a programmable logic controller configured to monitor the operation of the tunnel boring machine and produce warnings for an operator.

29. The tunnel boring machine according to claim 14, further comprising:

at least one muck bucket on the perimeter of the cutter head;

wherein the at least one muck bucket transports any material produced by boring out the tunnel and transports the material on to the conveyor through the interior of the first shield, the second shield, and the third shield to a rear portion of the tunnel.

30. The tunnel boring machine according to claim 14, wherein the second shield is attached to the third shield with an articulated joint.

31. The tunnel boring machine according to claim 14, wherein the cutter head provides an overbore capability by providing at least one cutting mechanism that is configured to change positions to expand a boring diameter of the cutter head.

* * * * *

UNITED STATES PATENT AND TRADEMARK OFFICE

CERTIFICATE OF CORRECTION

PATENT NO. : 7,832,960 B2
APPLICATION NO. : 12/337113
DATED : November 16, 2010
INVENTOR(S) : Lok Home, Brian Khalighi and John Turner It is certified that error appears in the above-identified patent and that said Letters Patent is hereby corrected as shown below:

Claim 9, line 4, “homblende” should be --hornblende--.

Signed and Sealed this
Eighteenth Day of January, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,832,960 B2
APPLICATION NO. : 12/337113
DATED : November 16, 2010
INVENTOR(S) : Lok Home, Brian Khalighi and John Turner It is certified that error appears in the above-identified patent and that said Letters Patent is hereby corrected as shown below:

Column 26, line 61 (Claim 9, line 4) “homblende” should be --hornblende--.

This certificate supersedes the Certificate of Correction issued January 18, 2011.

Signed and Sealed this
Fifteenth Day of February, 2011

David J. Kappos

David J. Kappos
*Director of the United States Patent and Trademark Office*